US009916961B2

(12) United States Patent
Canfield

(10) Patent No.: US 9,916,961 B2
(45) Date of Patent: Mar. 13, 2018

(54) X-RAY TUBE HAVING MAGNETIC QUADRUPOLES FOR FOCUSING AND STEERING

(71) Applicant: VAREX IMAGING CORPORATION, Salt Lake City, UT (US)

(72) Inventor: Bradley D. Canfield, Orem, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 412 days.

(21) Appl. No.: 14/660,625

(22) Filed: Mar. 17, 2015

(65) Prior Publication Data

US 2015/0187537 A1 Jul. 2, 2015

Related U.S. Application Data

(63) Continuation-in-part of application No. PCT/US2014/063015, filed on Oct. 29, 2014.
(Continued)

(51) Int. Cl.
*H01J 35/14* (2006.01)
*H01J 35/30* (2006.01)
(Continued)

(52) U.S. Cl.
CPC ..... *H01J 35/14* (2013.01); *H01J 35/06* (2013.01); *H01J 35/30* (2013.01); *H01J 35/305* (2013.01); *H05G 1/10* (2013.01); *H05G 1/52* (2013.01)

(58) Field of Classification Search
CPC ..... H01J 35/14; H01J 35/30; H01J 35/305; H01J 35/06; H01J 2235/06; H05G 1/10;
(Continued)

(56) References Cited

U.S. PATENT DOCUMENTS 5,812,632 A * 9/1998 Schardt ..... H01J 35/14 378/137
5,907,595 A * 5/1999 Sommerer ..... H01J 35/06 378/119
(Continued)

FOREIGN PATENT DOCUMENTS

WO 2012/167822 A1 12/2012

OTHER PUBLICATIONS

International Search Report and Written Opinion; PCT/US2014/063015, dated Feb. 3, 2015.

*Primary Examiner* — Glen Kao
(74) *Attorney, Agent, or Firm* — Maschoff Brennan

(57) ABSTRACT

An X-ray tube comprising: a cathode including an emitter; an anode; a first magnetic quadrupole formed on a first yoke and having a magnetic quadrupole gradient for focusing an electron beam in a first direction and defocusing the beam in a second direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and a pair of opposing quadrupole electromagnetic coils having alternating current offset being configured to deflect the electron beam in order to shift the focal spot of the electron beam on a target.

26 Claims, 15 Drawing Sheets

Related U.S. Application Data

(60) Provisional application No. 61/897,181, filed on Oct. 29, 2013.

(51) Int. Cl.
*H05G 1/52* (2006.01)
*H05G 1/10* (2006.01)
*H01J 35/06* (2006.01)

(58) Field of Classification Search
CPC .. H01G 1/12; H01G 1/14; H01G 1/18; H01G 1/20; H01G 1/52
See application file for complete search history.

(56) References Cited

U.S. PATENT DOCUMENTS

| | | | | |
|---|---|---|---|---|
| 6,292,538 | B1 | 9/2001 | Hell et al. | |
| 6,464,551 | B1 | 10/2002 | Lipkin et al. | |
| 7,839,979 | B2 | 11/2010 | Hauttmann et al. | |
| 2003/0025429 | A1 | 2/2003 | Hell et al. | |
| 2009/0154649 | A1* | 6/2009 | Behling | H01J 35/10 378/137 |
| 2010/0020937 | A1* | 1/2010 | Hautmann | H01J 35/30 378/137 |
| 2010/0195797 | A1 | 8/2010 | Hauttmann | |
| 2010/0207508 | A1 | 8/2010 | Terletska et al. | |
| 2010/0207580 | A1 | 8/2010 | Terletska et al. | |
| 2010/0316192 | A1 | 12/2010 | Hauttmann et al. | |
| 2012/0177185 | A1* | 7/2012 | Koppisetty | H01J 35/14 378/137 |

* cited by examiner

X-RAY TUBE HAVING MAGNETIC QUADRUPOLES FOR FOCUSING AND STEERING

CROSS-REFERENCE

This patent application is a continuation-in-part application of PCT Patent Application Serial No. PCT/US2014/063015 filed Oct. 29, 2014, which claims priority to U.S. Provisional Application Ser. No. 61/897,181 filed Oct. 29, 2013, which patent applications are incorporated herein by specific reference in their entireties.

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

In certain applications, it may be beneficial to lengthen the throw length of an X-ray tube. The throw length is the distance from cathode electron emitter to the anode surface. For example, a long throw length may result in decreased back ion bombardment and evaporation of anode materials back onto the cathode. While X-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. Also affected is the ability to properly focus and/or position the electron beam towards the anode target, again resulting in a less than desirable focal spot—either in terms of size, shape and/or position. When a focal spot size or location is unacceptable, it may be difficult to produce useful X-ray images.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size and position on an anode target. This helps to increase spatial resolution or to reduce artifacts in resulting images.

In one embodiment, an X-ray tube can include: a cathode including an electron emitter that emits an electron beam; an anode configured to receive the emitted electrons of the electron beam; a first magnetic quadrupole core between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil operably coupled to a power supply system that provides a constant current to each first quadrupole electromagnetic coil to produce a first focusing magnetic quadrupole field; a second magnetic quadrupole core between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil operably coupled to the power supply system that provides a constant current to each second quadrupole electromagnetic coil to produce a second focusing quadrupole field; and at least one coil of a pair of opposing quadrupole electromagnetic coils of the first or second quadrupole electromagnetic coils operably coupled to the power supply system that provides an alternating current offset to at least one coil of the pair of opposing quadrupole electromagnetic coils to shift the first and/or second focusing quadrupole field from the central axis of the first and/or second quadrupole yokes. In one aspect, the X-ray can include two coils of a pair or two pairs of opposing quadrupole electromagnetic coils of the first and/or second quadrupole electromagnetic coils, which pair of coils include at least one coil and optionally two coils operably coupled to the power supply system that provides an alternating current offset (e.g., AC offset) to one or both coils of one or two pairs of opposing quadrupole electromagnetic coils to shift the first and/or second focusing quadrupole field from the central axis of the first and/or second quadrupole yokes.

In one embodiment, a method of focusing and steering an electron beam in an X-ray tube can include: providing an X-ray tube of one of the embodiments (e.g., having at least one coil of a pair of opposing quadrupole electromagnetic coils with constant current for focusing and AC offset for steering); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating a power supply to provide an AC offset to at least one coil of a pair of opposing quadrupole electromagnetic coils so as to steer the electron beam away from the electron beam axis. In one aspect, the method can include operating two orthogonal pair of opposing quadrupole electromagnetic coils by providing AC offset to at least one coil of each pair so as to steer the electron beam away from the electron beam axis. In one aspect, the opposing quadrupole magnetic coils of a coil pair can be operated independently (e.g., one coil with offset the other coil without offset or at a different offset) so as to perturb the quadrupole field and move the center of the quadrupole field away from the central axis, thereby moving the electron beam away from the central axis.

In one embodiment, a method of focusing and steering an electron beam in an X-ray tube can include: providing the X-ray tube of one of the embodiments; operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; offsetting the first magnetic quadrupole to steer the electron beam away from the electron beam axis in a first direction; and offsetting the second magnetic quadrupole to steer the electron beam away from the electron beam axis in a second direction that is orthogonal to the first direction.

Certain embodiments include a magnetic system implemented as two magnetic quadrupoles disposed in the electron beam path of an X-ray tube. The quadrupoles are configured to focus in both directions perpendicular to the beam path, and to steer the beam in both directions perpendicular to the beam path. The two quadrupoles form a magnetic lens (sometimes referred to as a "doublet") and the focusing is accomplished as the beam passes through the quadrupole lens. The steering is accomplished by offsetting the coil alternating current in corresponding pairs of the quadrupole coils while maintaining the focusing coil constant current which results in an overall shift in the quadrupole's magnetic field. Steering of the beam occurs through appropriate coil pair energizing and can be done in one axis or a combination of axes perpendicular to the beam path. In one example, one quadrupole is used to focus in the first direction and the second quadrupole to focus in the second direction as well as steer in both directions. The two quadrupoles together form the quadrupole lens.

In sum, proposed embodiments provide an emitter with tunable emission capabilities as an electron source. The emitter can create a substantially laminar beam. The embodiments utilize two quadrupoles to focus the beam in two dimensions to a multiplicity of focal spot sizes, and one of the quadrupoles can steer the beam to focal spot positions for enhanced imaging performance. This also provides for creating a multiplicity of focal spot sizes from a single emitter; the focal spot size conceivably could be changed during an exam as well, which allows for the focal spot to be changed (e.g., focused and positioned) on the fly.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 6B shows a focused quadrupole field that is shifted in the x-direction, and FIG. 6C shows a focused quadrupole shifted in the y-direction.

DETAILED DESCRIPTION

Figure 1A:
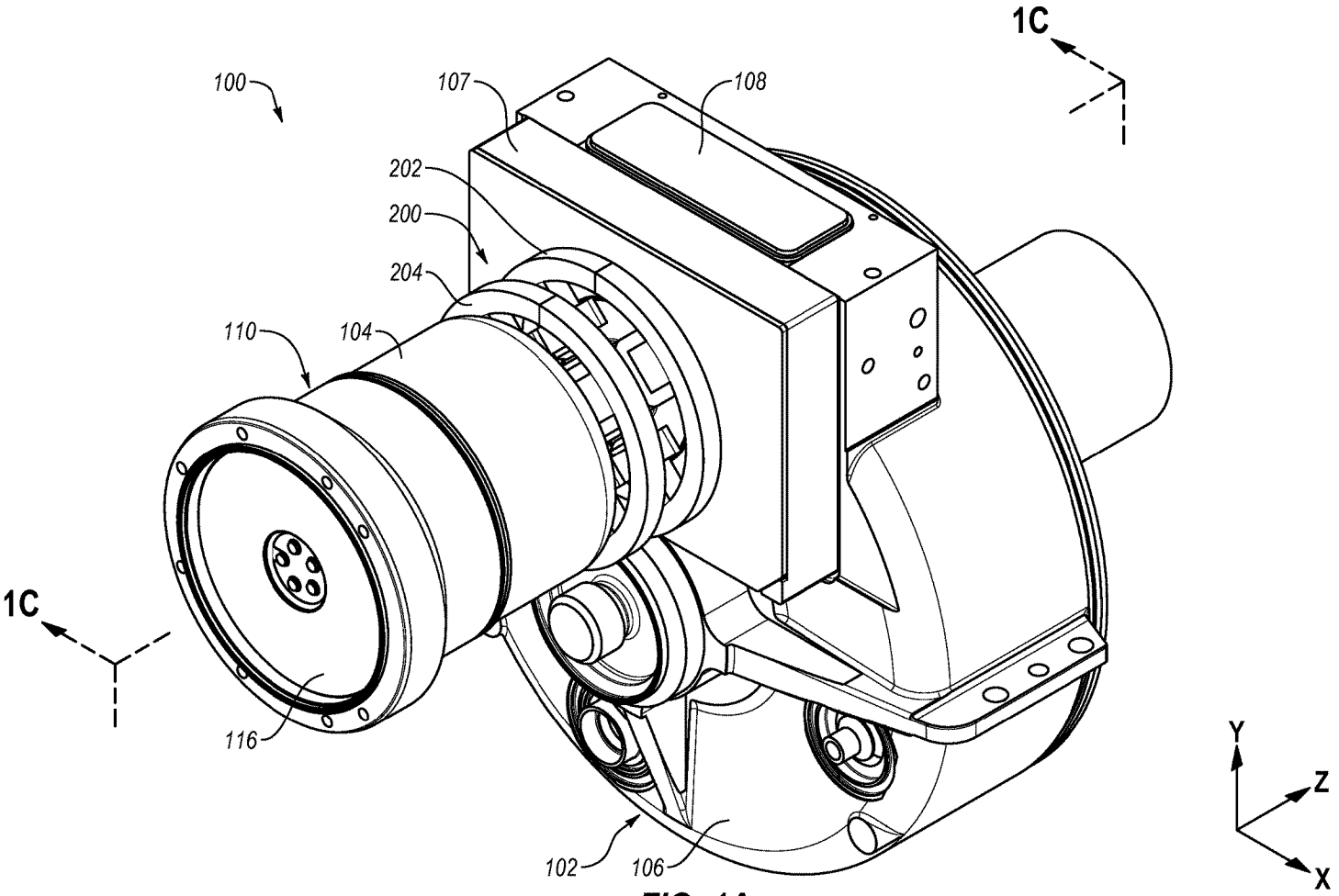
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed descriptions, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. General Overview of an Exemplary X-Ray Tube

Embodiments of the present technology are directed to X-ray tubes of the type having a vacuum housing in which a cathode and an anode are arranged. The cathode includes an electron emitter that emits electrons in the form of an electron beam that is substantially perpendicular to a face of the emitter, and the electrons are accelerated due to a voltage difference between the cathode and the anode so as to strike a target surface on the anode in an electron region referred to as a focal spot. Embodiments can also include an electron beam focusing and/or steering component that is configured to manipulate the electron beam by: (1) deflecting, or steering, the electron beam, and thereby altering the position of the focal spot on the anode target; and/or (2) focusing the electron beam so as to alter the dimensions of the focal spot. Different embodiments utilize different configurations of such focusing and/or steering components, such as magnetic systems, including combinations of electromagnets formed as quadrupoles via coil elements with current flowing therein and disposed on a carrier/yoke comprised of a suitable material.

The embodiments can include an electron beam focusing component that includes two magnetic quadrupole cores. Generally, each magnetic quadrupole core can have a yoke with four pole projections evenly distributed therearound, and each pole projection can include an electromagnetic coil so that all four electromagnets provide the magnetic quadrupole moment. One quadrupole core can narrow the electron beam in the length direction, and the other quadrupole core can narrow the electron beam in the width direction. Thereby, the combination of the two quadrupole cores can cooperate to focus the electron beam, which allows precise length and width dimension control of the focal spot on the anode. However, either or both quadrupole cores can focus in the length and width directions. The quadrupoles can include coils that have constant current to achieve the focusing effect. Also, a pulse width modulated circuit coupled with the coils can create constant current in the coils because the coils are current integrating devices. For example, a current pulse train into the coil can cause the coil to create a constant current in the coil, which can be changed by changing the current pulse train. Also a DC power supply can provide constant current (e.g., DC current).

The embodiments can include an electron beam steering component that includes one of the magnetic quadrupole cores being configured to operate each electromagnet separately to change the magnetic field in order to move the electron beam in two dimensions away from the central axis, such as movement of the focal spot on the anode target surface. The quadrupole core closest to the anode (e.g., anode quadrupole core) can have a yoke with four pole projections evenly distributed therearound that each have a quadrupole magnetic coil with independent magnetic control, such as by having independent current control. Accordingly, the anode quadrupole core can have electromagnets wound around the pole projections on the yoke. The anode quadrupole core can steer the electron beam in any direction or toward any quadrant. The anode quadrupole core can impart a magnetic field that nudges and deflects the electron beam, and then the electron beam coasts to the target anode. However, the quadrupole core closest to the cathode (e.g., cathode quadrupole core) can be configured for focusing and steering while the anode quadrupole core only focuses. In an alternative configuration, the cathode quadrupole core can focus and steer in a first direction, and the anode quadrupole core can focus and steer in a second direction that is perpendicular to the first direction. One example of an X-ray tube that has certain of these features—discussed in further detail below—is shown in FIGS. 1A-1D.

Steering can be accomplished by moving the center of the quadrupole field away from a central axis, where the central axis can be the natural (e.g., unperturbed) electron beam axis or aligned central axis of the quadrupole cores. Introducing an AC offset to one coil, a pair of coils, three coils, or two pair of coils of the coils of the quadrupole cores can provide the shift of the quadrupole field. This may be an asymmetric quadrupole field that has focusing that is focused off the central axis. The quadrupole field can be shifted off axis from the central axis or off the central axes of the cores. The quadrupole still provides focusing by the center being shifted off axis, and the electron beam follows the center of the shifted quadrupole field. While the constant focusing current provides focusing, the AC offset to one coil or a pair of coils or three coils or two pairs of coils can shift the center of the quadrupole field away from center of the quadrupole cores. The shifted quadrupole field is similar to a dipole effect being superimposed over a quadrupole field. The AC offset to each coil for a core can be independent and different to get steering. The AC offset can be time vary steering current.

In one embodiment, the X-ray-tube can be included in an X-ray system, such as a CT system, and can include electron beam control. The X-ray tube can have high power with focusing and 2-dimensional beam movement controllability with a short or a long throw between the cathode and anode. The X-ray tube can control the beam to a defined emission area for the beam or focal spot area or shape or location on the anode. The X-ray tube can focus the electron beam in two dimensions under active beam manipulation by a cathode quadrupole and anode quadrupole core. The X-ray tube can steer the electron beam in two dimensions under active beam manipulation by an anode quadrupole core having independent control of the electromagnets so as to provide AC offset to one or each of the anode quadrupole electromagnetic coils. Such beam steering can be implemented in imaging methods to provide a richer CT data set, where the rich CT data set can be used to improve resolution of an image from the CT. The improved resolution can improve resolution in the slice and row directions of the CT, for example, as per being received (e.g., seen) by the detector. Beam steering can be useful to implement data oversampling of the X-ray by allowing for multiple focal spot locations for a given X-ray imaging time duration. In one aspect, the anode quadrupole core can be configured only for focusing, while the cathode quadrupole core can be for focusing and/or steering.

In one embodiment, the cathode emits an electron beam that flows from the cathode toward the anode such that the beam spreads the electrons apart during transit, and one or more of the quadrupole cores focus the electron beam to a defined focal spot. In one aspect, both quadrupole cores provide a focusing effect on the electron beam. This allows for both beam width (e.g., X axis) and beam length (e.g., Y axis) focusing, wherein one quadrupole core focuses in the length and the other quadrupole core focuses in the width. This also allows for the ability of the X-ray tube to create a plurality of different types of focal spot sizes and shapes from a single planar emitter, where such changes of focusing and change of beam length and/or width can be performed during imaging, such as during a CT examination. However, movement of the X-ray in the Z axis may be desirable, and due to the angle of the anode target surface, steering of the electron beam in the Y axis can cause the X-ray to move in the Z axis.

In one embodiment, the X-ray tube can perform beam focusing with high magnetic flux in a small throw volume or space. The magnetic material suitable for high magnetic flux can be a material that does not saturate and can be used for the quadrupole cores in the yokes, such as the yokes for two adjacent quadrupole cores. Also, the quadrupole pole projections can be the same material as the yokes. Such a material can be iron.

In one embodiment, the quadrupole core configured for focusing and steering can include a magnetic material that has high dynamic response, which material can be used for the yoke and pole projections. The material can have less magnetic flux than the material of the quadrupole core that is configured for only focusing. The material of the steering quadrupole core can be configured so that it does not saturate at low levels, and it responds to several orders of magnitude faster than the iron material used for the focusing-only quadrupole cores. The steering quadrupole core material can be iron based ferrite with lower saturation flux levels. However, the ferrite material allows for the quadrupole core to respond to flux changes much faster compared to iron, which is beneficial for switching magnetic fields, such as in steering. The material allows up to 7 kHz switching and as low as about 20 microseconds transitions. In one aspect, the steering quadrupole core material can be a ferrite material. The ferrite can be an iron ceramic, such as iron oxide, which can have different magnetic characteristics compared to the focusing-only quadrupole core material.

In one embodiment, the X-ray can include 0 degrees on an axis, and the two quadrupoles having the pole projections and the electromagnets aligned, which can be referenced at 45, 135, 225 and 315 degrees.

In one embodiment, the pole faces of the pole projections can have a reduced profile, such as from ¼ to ⅜ inches across. This can include the pole faces of any of the pole projections, such as for the focusing or steering quadrupole cores.

In one embodiment, the steering quadrupole core can have electromagnets on the pole projections that each has its own supply line for power and operation, which can be independently controlled.

In one embodiment, the cores each can include fluidic pathways fluidly coupled to a coolant system, which allows coolant to flow through the yokes, and optionally through the pole projections. As such, each pole projection can have a fluid inlet pathway and a fluid outlet pathway coupled to a fluid pathway in the yoke.

Figure 1B:
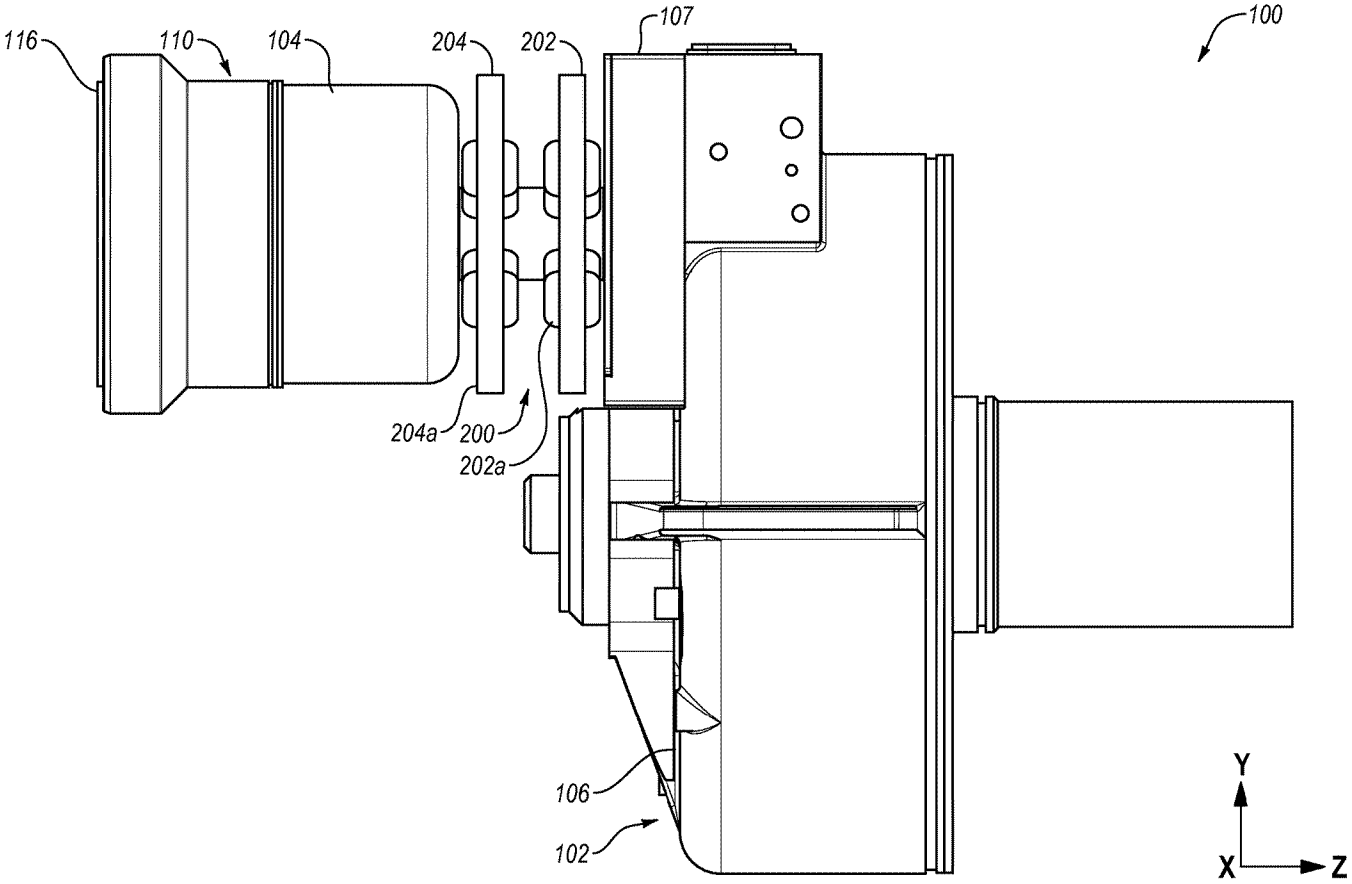
FIG. 1B is a side view of the X-ray tube of FIG. 1A.
Figure 1C:
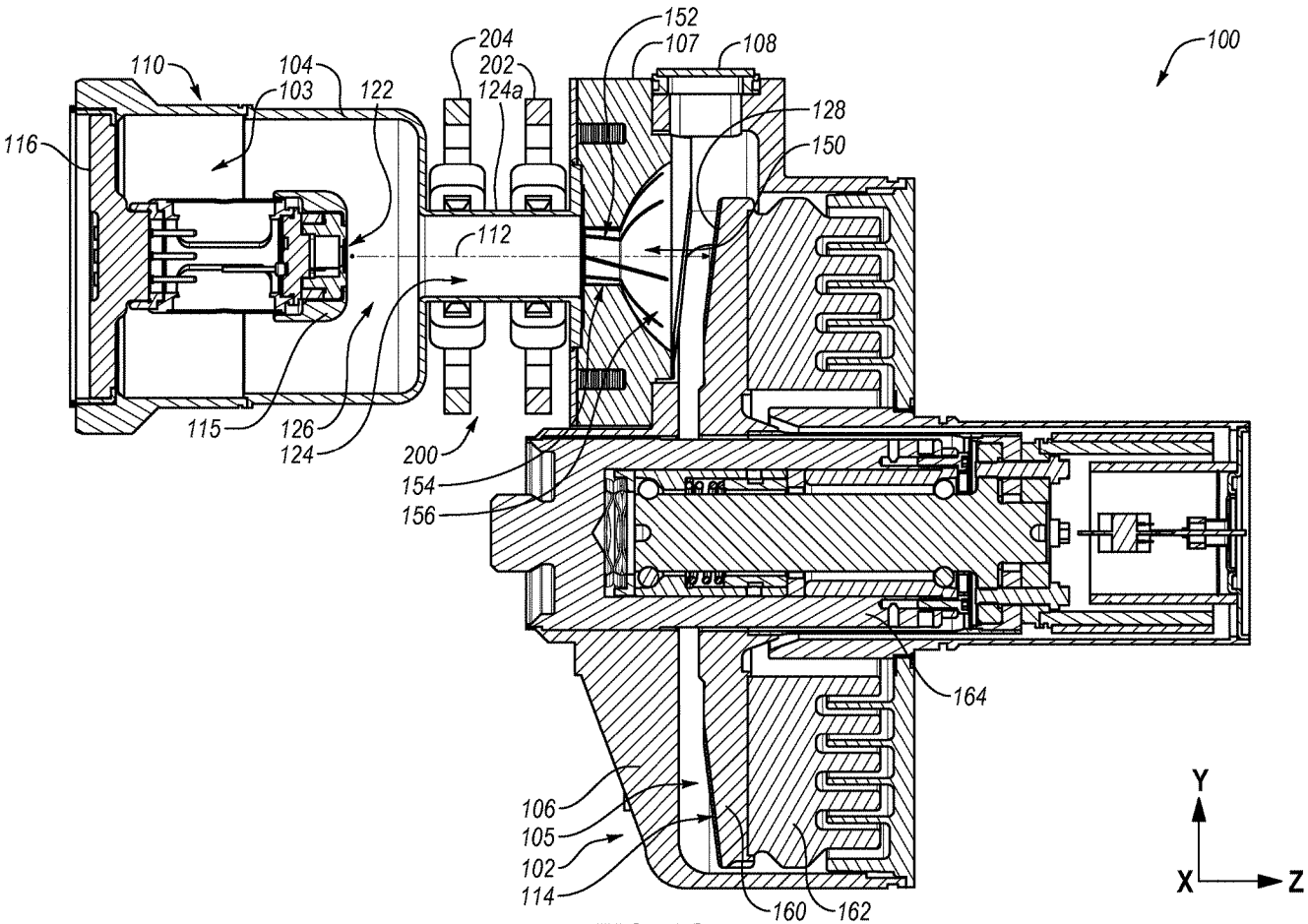
FIG. 1C is a cross-sectional view of the X-ray tube of FIG. 1A.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and is not meant to limit the embodiments described herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum structure 102 may include a cathode housing 104 and an anode housing 106. The cathode housing 104 may be secured to the anode housing 106 such that an interior cathode volume 103 is defined by the cathode housing 104, and an interior anode volume 105 is defined by the anode housing 106, each of which are joined so as to define the vacuum enclosure 102.

In some embodiments, the vacuum enclosure 102 is disposed within an outer housing (not shown) within which a coolant, such as liquid or air, is circulated so as to dissipate heat from the external surfaces of the vacuum enclosure 102. An external heat exchanger (not shown) is operatively connected so as to remove heat from the coolant and recirculate it within the outer housing.

The X-ray tube 100 depicted in FIGS. 1A-1C includes a shield component (sometimes referred to as an electron shield, aperture, or electron collector) 107 that is positioned between the anode housing 106 and the cathode housing 104 so as to further define the vacuum enclosure 102. The cathode housing 104 and the anode housing 106 may each be welded, brazed, or otherwise mechanically coupled to the shield 107. While other configurations can be used, examples of suitable shield implementations are further described in U.S. patent application Ser. No. 13/328,861 filed Dec. 16, 2011 and entitled "X-ray Tube Aperture Having Expansion Joints," and U.S. Pat. No. 7,289,603 entitled "Shield Structure And Focal Spot Control Assembly For X-ray Device," the contents of each of which are incorporated herein by reference for all purposes.

The X-ray tube 100 may also include an X-ray transmissive window 108. Some of the X-rays that are generated in the X-ray tube 100 may exit through the window 108. The window 108 may be composed of beryllium or another suitable X-ray transmissive material.

With specific reference to FIG. 1C, the cathode housing 104 forms a portion of the X-ray tube 100 referred to as a cathode assembly 110. The cathode assembly 110 generally includes components that relate to the generation of electrons that together form an electron beam, denoted at 112. The cathode assembly 110 may also include the components of the X-ray tube between an end 116 of the cathode housing 104 and an anode 114. For example, the cathode assembly 110 may include a cathode head 115 having an electron emitter, generally denoted at 122, disposed at an end of the cathode head 115. As will be further described, in disclosed embodiments the electron emitter 122 can be configured as a planar electron emitter. When an electrical current is applied to the electron emitter 122, the electron emitter 122 is configured to emit electrons via thermionic emission, that together form a laminar electron beam 112 that accelerates towards the anode target 128.

The cathode assembly 110 may additionally include an acceleration region 126 further defined by the cathode housing 104 and adjacent to the electron emitter 122. The electrons emitted by the electron emitter 122 form an electron beam 112 and traverse through the acceleration region 126 and accelerate towards the anode 114 due to a suitable voltage differential. More specifically, according to the arbitrarily-defined coordinate system included in FIGS. 1A-1C, the electron beam 112 may accelerate in a z-direction, away from the electron emitter 122 in a direction through the acceleration region 126.

The cathode assembly 110 may additionally include at least part of a drift region 124 defined by a neck portion **124*a* of the cathode housing 104. In this and other embodiments, the drift region 124 may also be in communication with an aperture 150 provided by the shield 107, thereby allowing the electron beam 112 emitted by the electron emitter 122 to propagate through the acceleration region 126, the drift region 124 and aperture 150 until striking the anode target surface 128. In the drift region 124, a rate of acceleration of the electron beam 112 may be reduced from the rate of acceleration in the acceleration region 126. As used herein, the term "drift" describes the propagation of the electrons in the form of the electron beam 112 through the drift region 124**.

Positioned within the anode interior volume 105 defined by the anode housing 106 is the anode 114. The anode 114 is spaced apart from and opposite to the cathode assembly 110 at a terminal end of the drift region 124. Generally, the anode 114 may be at least partially composed of a thermally conductive material or substrate, denoted at 160. For example, the conductive material may include tungsten or molybdenum alloy. The backside of the anode substrate 160 may include additional thermally conductive material, such as a graphite backing, denoted by way of example here at 162.

The anode 114 may be configured to rotate via a rotatably mounted shaft, denoted here as 164, which rotates via an inductively induced rotational force on a rotor assembly via ball bearings, liquid metal bearings or other suitable structure. As the electron beam 112 is emitted from the electron emitter 122, electrons impinge upon a target surface 128 of the anode 114. The target surface 128 is shaped as a ring around the rotating anode 114. The location in which the electron beam 112 impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the impinging electrons to generate X-rays in a manner that is well known.

During operation of the X-ray tube 100, the anode 114 and the electron emitter 122 are connected in an electrical circuit. The electrical circuit allows the application of a high voltage potential between the anode 114 and the electron emitter 122. Additionally, the electron emitter 122 is connected to a power source such that an electrical current is passed through the electron emitter 122 to cause electrons to be generated by thermionic emission. The application of a high voltage differential between the anode 114 and the electron emitter 122 causes the emitted electrons to form an electron beam 112 that accelerates through the acceleration region 126 and the drift region 124 towards the target surface 128. Specifically, the high voltage differential causes the electron beam 112 to accelerate through the acceleration region 126 and then drift through the drift region 124. As the electrons within the electron beam 112 accelerate, the electron beam 112 gains kinetic energy. Upon striking the target surface 128, some of this kinetic energy is converted into electromagnetic radiation having a high frequency, i.e., X-rays. The target surface 128 is oriented with respect to the window 108 such that the X-rays are directed towards the window 108. At least some portion of the X-rays then exit the X-ray tube 100 via the window 108.

Additionally, FIG. 1C shows a cross-sectional view of an embodiment of a cathode assembly 110 that can be used in the X-ray tube 100 with the planar electron emitter 122 and magnetic system 200 described herein. As illustrated, a throw path between the electron emitter 122 and target surface 128 of the anode 114 can include the acceleration region 126, drift region 124, and aperture 150 formed in shield 107. In the illustrated embodiment, the aperture 150 is formed via aperture neck 154 and an expanded electron collection surface 156 that is oriented towards the anode 114.

Optionally, one or more electron beam manipulation components can be provided. Such devices can be implemented so as to "steer" and/or "deflect" the electron beam 112 as it traverses the drift region 124, thereby manipulating or "toggling" the position of the focal spot on the target surface 128. Additionally or alternatively, a manipulation component can be used to alter or "focus" the cross-sectional shape of the electron beam and thereby change the shape of the focal spot on the target surface 128. In the illustrated embodiments electron beam focusing and steering are provided by way of a magnetic system denoted generally at 200.

The magnetic system 200 can include various combinations of focusing quadrupole and steering quadrupole implementations that are disposed so as to impose magnetic forces on the electron beam 112 so as to focus and/or steer the beam. One example of the magnetic system 200 is shown in FIGS. 1A-1D. In this embodiment, the magnetic system 200 is implemented as two magnetic quadrupole cores 202, 204 disposed in the electron beam path 112 of the X-ray tube. The combination of the two quadrupole cores 202, 204 are configured to (a) focus in both directions perpendicular to the beam path, and (b) to steer the beam in both directions perpendicular to the beam path. In this way, the two quadrupole cores 202, 204 act together to form a magnetic lens (sometimes referred to as a "doublet"), and the focusing and steering is accomplished as the electron beam passes through the quadrupole "lens." The "focusing" provides a desired focal spot shape and size, and the "steering" affects the positioning of the focal spot on the anode target surface 128. Each quadrupole is implemented with a core section, or a yoke, denoted as a cathode quadrupole yoke at 204*a*, and an anode quadrupole yoke at 202*a*.

Figure 2A:
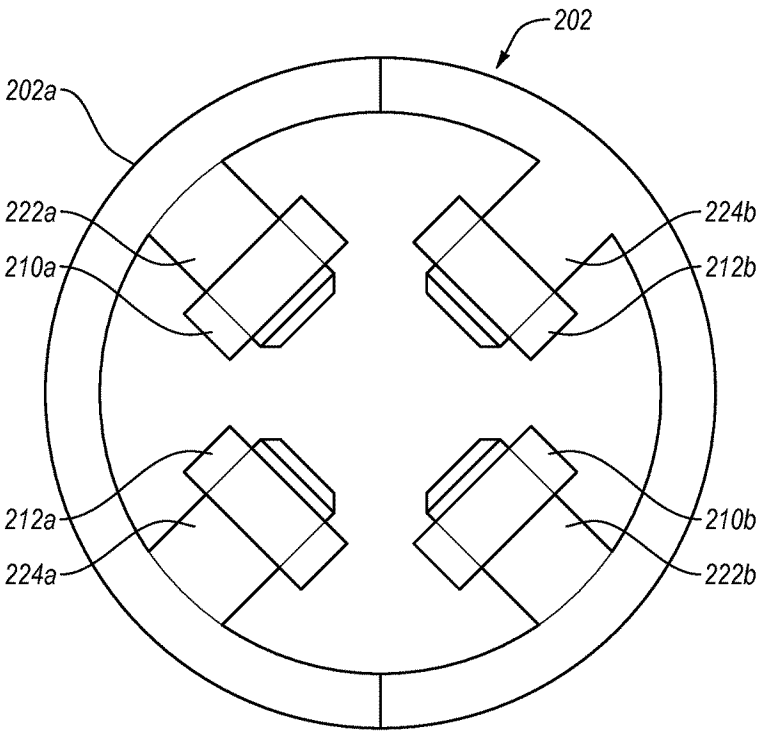
FIG. 2A shows an embodiment of an anode core quadrupole.
Figure 2B:
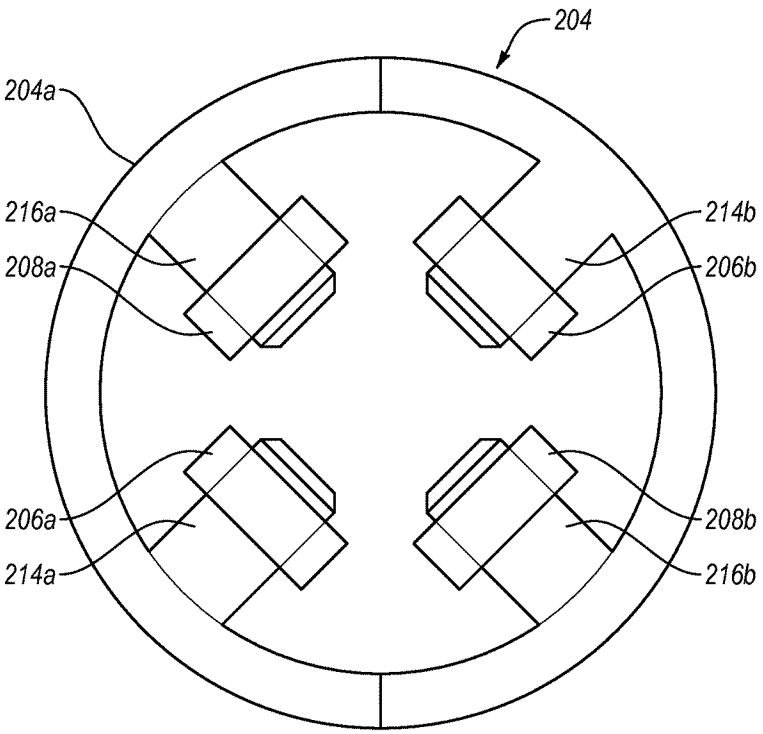
FIG. 2B shows an embodiment of a cathode core quadrupole.

FIG. 2A shows an embodiment of an anode quadrupole core 202 (e.g., closer to anode) having an anode quadrupole yoke 202*a*, and FIG. 2B shows an embodiment of a cathode quadrupole core 204 (e.g., closer to cathode) having a cathode quadrupole yoke 204*a*. Each quadrupole yoke 202*a*, 204*a* includes four pole projections arranged in an opposing relationship, cathode pole projections 214*a,b* (e.g., first cathode pole projections) and 216*a,b* (e.g., second cathode pole projections) on the cathode yoke 204*a*, and anode pole projections 222*a,b* (e.g., first anode pole projections) and 224*a,b* (e.g., second anode pole projections) on the anode yoke 202*a*. Each quadrupole pole projection includes corresponding electromagnetic coils, denoted as cathode coils 206*a,b* (e.g., first cathode coils) and 208*a,b* (e.g., second cathode coils) on the cathode yoke 204*a* and anode coils 210*a,b* (e.g., first anode coils) and 212*a,b* (e.g., second anode coils) on the anode yoke 202*a*. Current is supplied to the coils so as to provide the desired magnetic focusing and/or steering effect, as will be described in further detail below.

Figure 1D:
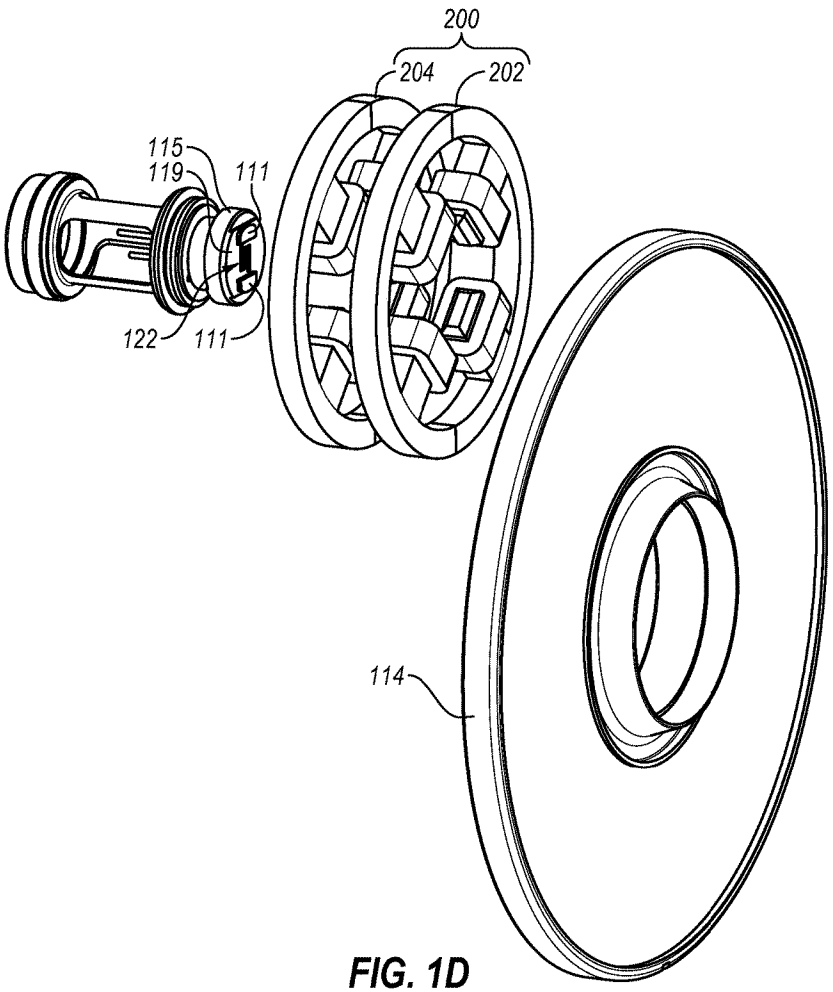
FIG. 1D is a perspective view of internal components of the X-ray tube of FIG. 1A.

FIG. 1D shows the components of the X-ray device 100 that are arranged for electron emission, electron beam steering and/or focusing, and X-ray emission. In FIG. 1D, disposed within the beam path is the magnetic system 200 configured to focus and steer the electron beam before reaching the anode 114, as noted above. A portion of the cathode assembly 110 has the cathode head 115 with the electron emitter 122 on an end of the cathode head 115 so as to be oriented or pointed toward the anode 114 (see FIG. 1C for orientation). The cathode head 115 can include a head surface 119 that has an emitter region that is formed as a recess that is configured to receive the electron emitter 122 (e.g., planar electron emitter). The head surface 119 also includes electron beam focusing elements 111 located on opposite sides of the electron emitter 122.

In one embodiment, the electron emitter 122 can be comprised of a tungsten foil, although other materials can be used. Alloys of tungsten and other tungsten variants can be used. Also, the emitting surface can be coated with a composition that reduces the emission temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

II. Example Embodiments of a Magnetic System Providing Electron Beam Focusing and Two-Axis Beam Steering Via Two Quadrupoles As noted above, certain embodiments include an electron beam manipulation component that allows for steering and/or focusing of the electron beam so as to control the position and/or size and shape of the focal spot on the anode target. In one embodiment, this manipulation is provided by way of a magnetic system implemented as two magnetic quadrupoles disposed in the electron beam path. For example, in one embodiment, two quadrupoles are used to provide both steering and focusing of the electron beam. In this approach, focusing magnetic fields can be provided by both quadrupoles (e.g., the anode side quadrupole and the cathode side quadrupole with constant current in the coils) and the electron beam steering magnetic fields can be provided by one of the quadrupoles (e.g., the anode side quadrupole or cathode side quadrupole) that is operated with AC offset for one coil, one pair, three coils, or two pairs of opposing coils. Alternatively, magnetic fields for steering can be done for one direction with one quadrupole having d a single coil or an opposing pair of coils with AC offset and for the other direction with the other quadrupole having a single coil or an opposing pair of coils with AC offset, where the two pairs with AC offset are orthogonal or perpendicular. The steering can be performed by providing the offset to one coil, a pair of coils, three coils, or all four coils. When a single coil has the offset, then the movement of the beam can be diagonal. In this way, combined beam focusing and steering can be provided using only quadrupoles. This particular approach can use two quadrupoles that are each configured for focusing and one of the quadrupoles is configured for steering.

Figure 3A:
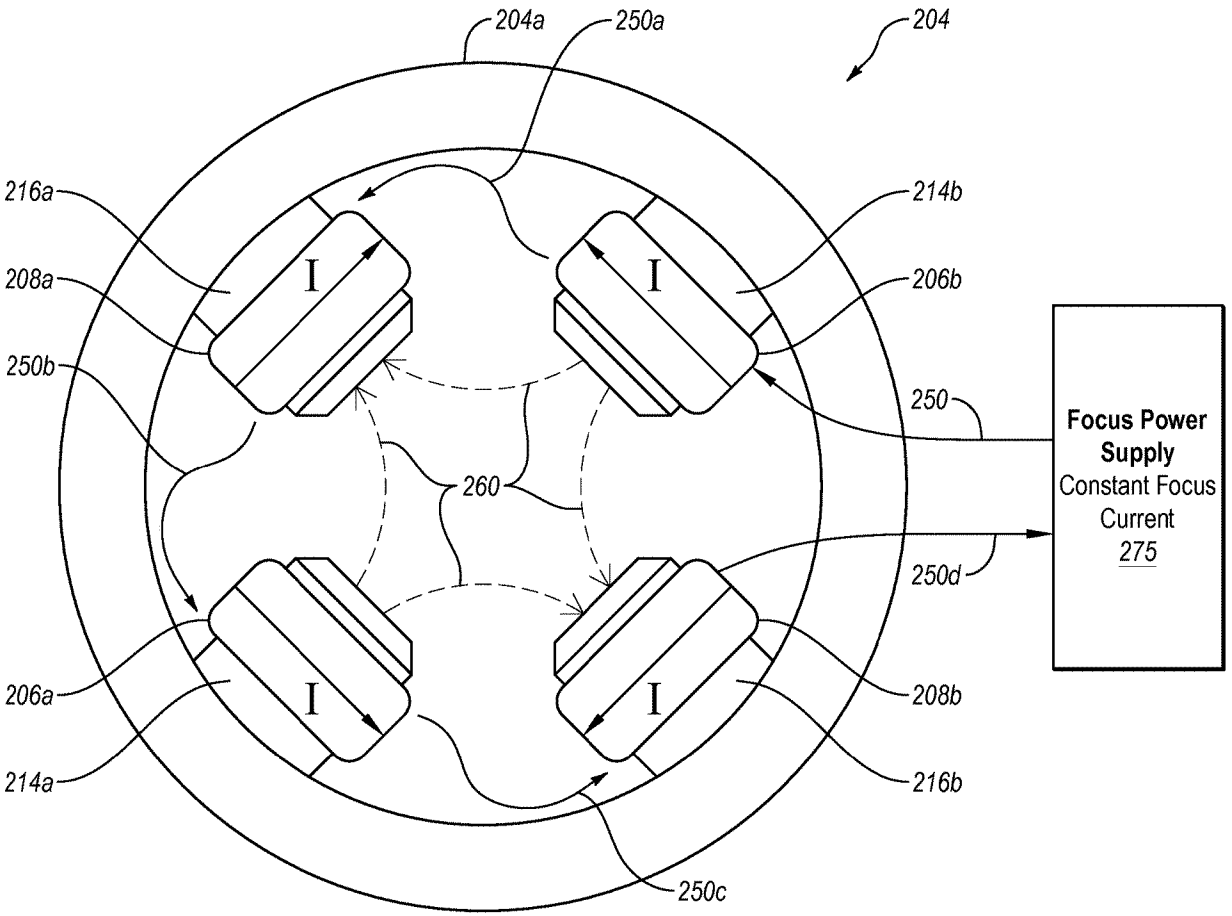
FIGS. 3A-3B are a top view of one embodiment of a quadrupole magnetic system.
Figure 3B:
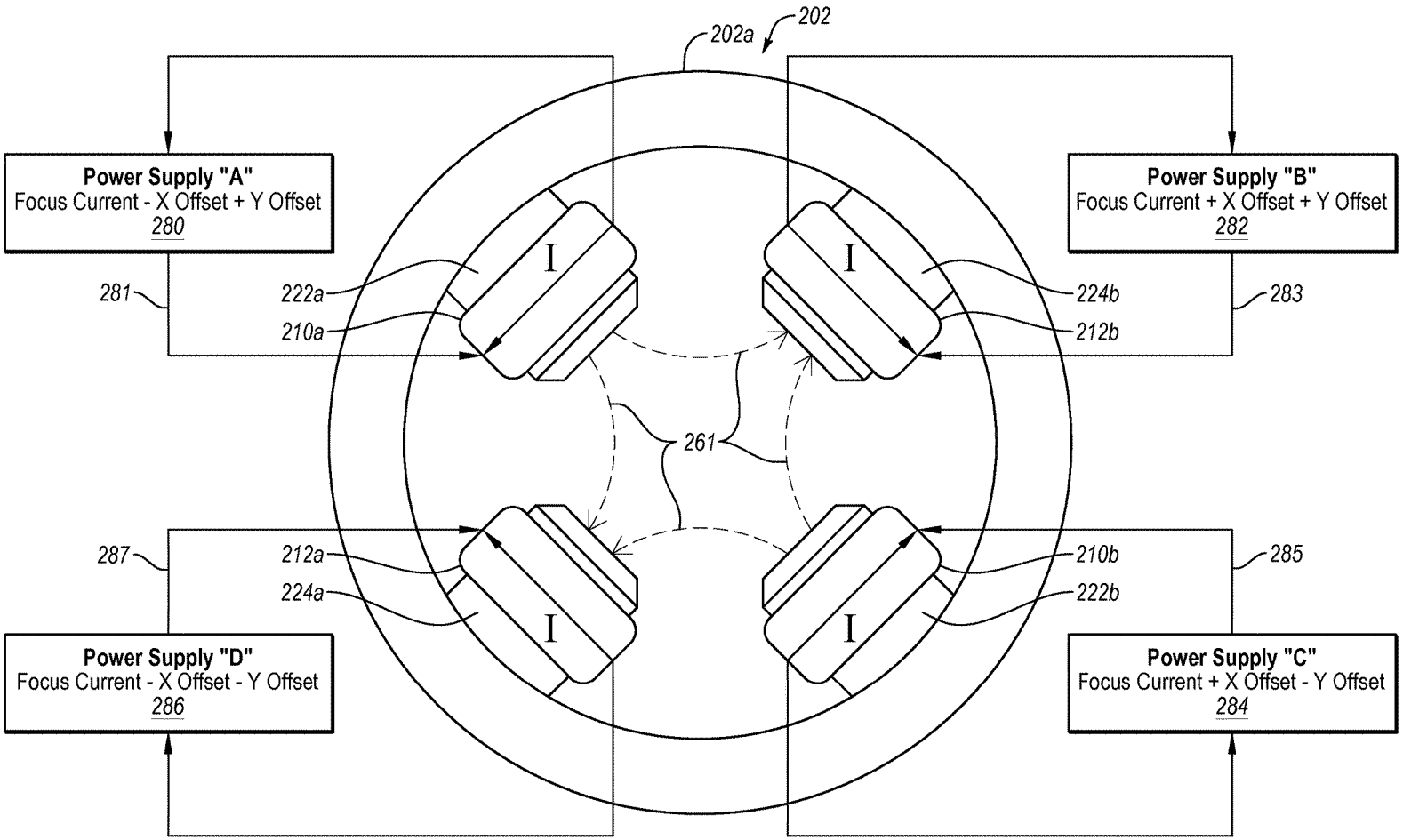

In this context, in conjunction with the embodiments shown in FIGS. 1A-1D and 2A-2B (with reference to the magnetic system 200 in particular), reference is further made to FIGS. 3A and 3B. FIG. 3A shows an embodiment of a cathode core 204 having a cathode yoke 204*a* and is configured as a quadrupole (e.g., cathode-side magnetic quadrupole 204), and FIG. 3B illustrates an embodiment of an anode core 202 having an anode yoke 202*a*, also configured as a quadrupole (e.g., anode-side magnetic quadrupole 202). As previously described in connection to FIGS. 2A-2B, in this example each core section includes a yoke having four pole projections arranged in an evenly distributed and opposing relationship, pole projections 214*a,b* and 216*a,b* on the cathode yoke 204*a*, and pole projections 222*a,b* and 224*a,b* on the anode yoke 202*a*. Each pole projection includes corresponding coils, denoted at 206*a,b* and 208*a,b* on the cathode core 204 and 212*a,b* and 210*a,b* on the anode core 202. While illustrated as having a substantially circular shape, it will be appreciated that each of the core (or yoke) portions 202*a*, 204*a* can also be configured with different shapes, such as a square orientation, semi-circular, oval, or other.

The two magnetic quadrupole cores 202, 204 act as lenses, and may be arranged so that the corresponding electromagnets thereof are in parallel with respect to each other, and perpendicular to the optical axis defined by the electron beam 112. The quadrupole cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have symmetry with respect to the optical axis or with respect to a plane through the optical axis.

With continued reference to the figures, the double magnetic quadrupole includes an anode quadrupole core, generally designated at 202 and a second cathode quadrupole core, generally designated at 204, that are together positioned approximately between the cathode and the target anode and disposed around the neck portion 124*a* as previously described. The anode quadrupole core 202 in one option can be further configured to provide AC offset to one coil, a pair of coils, or two pairs of opposing coils that enables a shifting of the focal spot in a plane perpendicular to an optical axis correspondent to electron beam 112 of the X-ray device. In an example embodiment, the cathode quadrupole core 204 focuses in a length direction, and defocuses in width direction of the focal spot. The electron beam is then focused in width direction and defocused in length direction by the following anode quadrupole core 202. In combination the two sequentially arranged magnetic quadrupoles ensure a net focusing effect in both directions of the focal spot. However, the focusing and defocusing axes of the two different cores can be switched between the anode core 202 and cathode core 204.

With continued reference to FIG. 3A, a top view of a cathode quadrupole core 204 is shown. A circular core or yoke portion, denoted at 204*a* is provided, which includes four pole projections 214*a*, 214*b*, 216*a*, 216*b* that are directed toward the center of the circular yoke 204*a*. In an example implementation, the yoke 204*a* and the pole projections 214*a*, 214*b*, 216*a*, 216*b* are constructed of core iron. Moreover each coil is comprised of 22 gauge magnet wire at 60 turns; obviously other configurations can be suitable depending on the needs of a particular application.

Figure 6A:
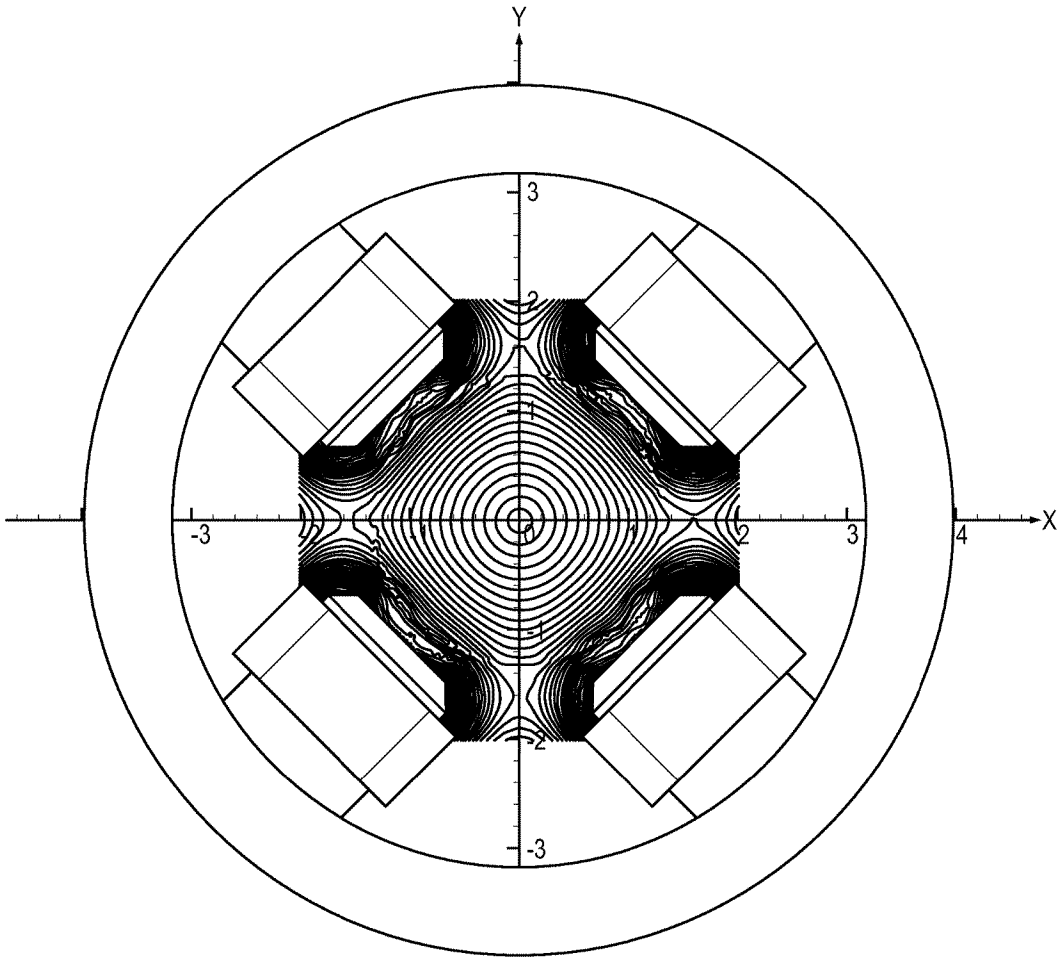
FIGS. 6A-6C are each a schematic diagram showing an example of magnetic fields resulting from quadrupole fields, with FIG. 6A showing a focused quadrupole field that is not shifted.

As is further shown in FIG. 3A, the illustrated example includes a Focus Power Supply 275 for providing a predetermined current to the four coils, which are connected in electrical series, as denoted schematically at 250, 250*a*, 250*b* 250*c*, and 250*d*. In this embodiment, the current supplied is configured so that the coil has substantially constant current, and results in a current flow within each coil as denoted by the letter 'I' and corresponding arrow, in turn resulting in a magnetic field schematically denoted at 260. The magnitude of the current is selected so as to provide a desired magnetic field that results in a desired focusing effect. See FIG. 6A, which shows focusing of the focal spot.

Reference is next made to FIG. 3B, which illustrates an example of a top view of an anode quadrupole core 202 having a circular core or yoke 202*a*, which includes four pole projections 222*a*, 222*b*, 224*a*, 224*b* also directed toward the center of the circular yoke 202*a*. The anode quadrupole core 202 and four pole projections 222*a*, 222*b*, 224*a*, 224*b* can be comprised of a low loss ferrite material so as to better respond to steering frequencies (described herein). The coils can utilize similar gauge magnet wire and similar turn ratio, with variations depending on the needs of a given application. In one option, if steering frequency is sufficiently low, then iron can be used in the steering core instead of ferrite.

As is further shown in the example embodiment of FIG. 3B, and in contrast with the cathode quadrupole core 204, each of the coils of the anode quadrupole core 202 includes a separate and independent power source for providing current to induce a magnetic field in a respective coil, each power supply being denoted at 280 (Power Supply A), 282 (Power Supply B), 284 (Power Supply C) and 286 (Power Supply D). For purposes of providing a quadrupole magnetic field, a constant current (e.g., DC) 'Focus Current' is provided in each of the coils, as denoted by the schematic electrical circuit associated with each supply (e.g., 281, 283, 285, 287). Accordingly, any current can be provided that results in substantially constant current in the coils. Moreover, as denoted by current flow directional arrows at 'I' and corresponding arrow, in turn resulting in a magnetic field schematically denoted at 261. The focus current in the anode quadrupole core 202 is opposite to the cathode quadrupole core 204 focus current so as to provide for complimentary magnetic fields, and thereby the focusing effect.

Figure 6B:
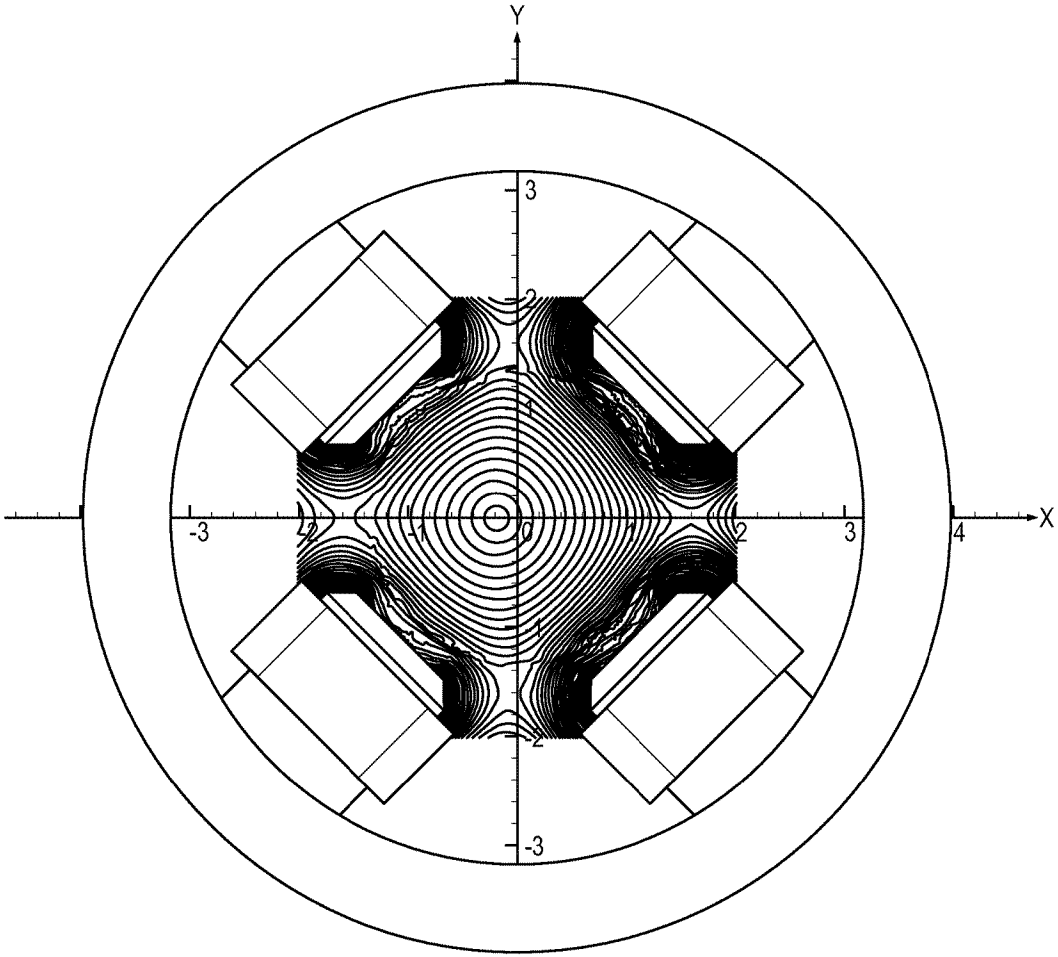
Figure 6C:
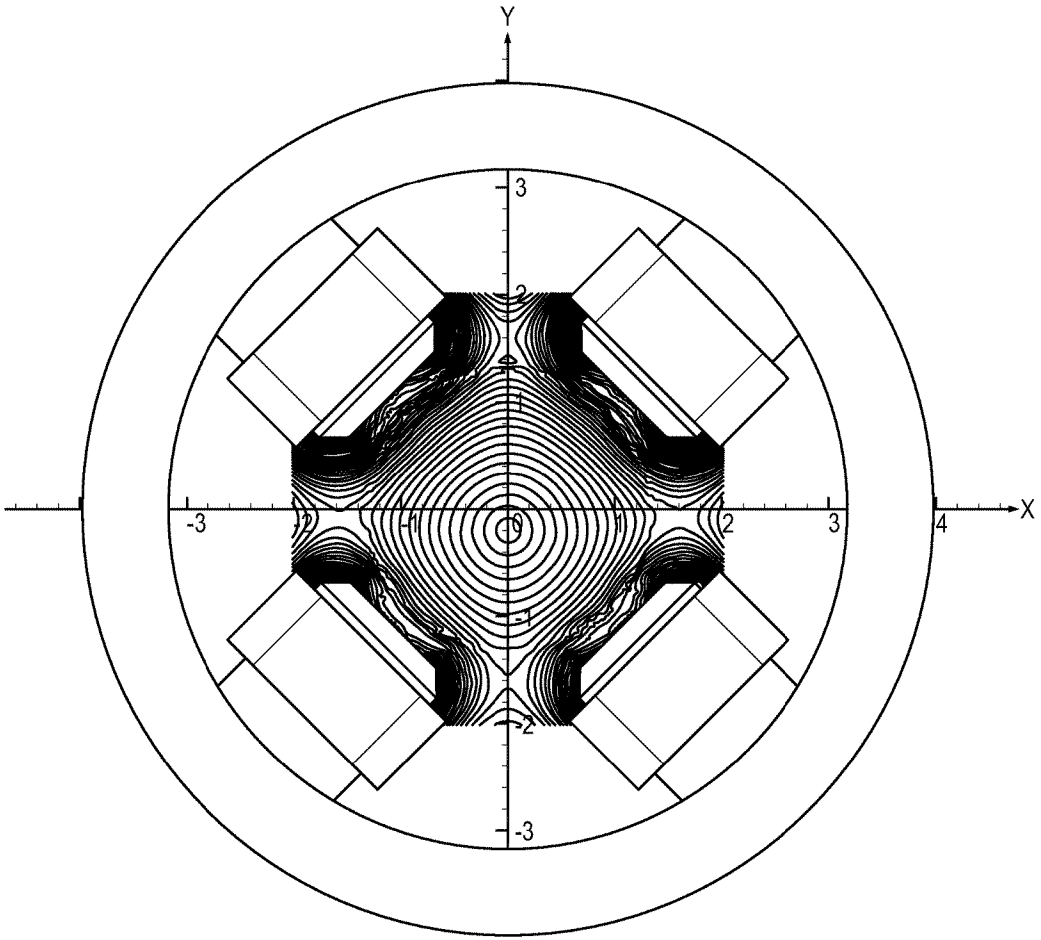

As previously discussed, the anode quadruple core 202 is further configured to receive AC offset in addition to the constant current in each of the coils. To do so, each of the coils is provided with—in addition to the constant focus current described above—an X AC offset current and a Y AC offset current. However, the AC offset can be zero for one or more coils so long as at least one coil has an AC offset that imparts steering. The duration of the AC offset currents are at a predetermined frequency and the respective offset current magnitudes are designed to achieve an offset or shifting of the center of the quadrupole field from the central axis, in turn, a resultant shift in the electron beam (and focal spot) from a central axis of the cores. Thus, each coil is driven independently, with a constant focus current, and perturbations are created in the magnetic field at the desired focal spot steering frequency by application of desired X offset and Y offset AC currents in corresponding coils or coil pairs (e.g., opposing coils) of the anode quadrupole core 202. This effectively moves the center of the quadrupole magnetic field in the 'x' and/or 'y' direction (see, for example, FIGS. 6B and 6C, which show a representative steering effect), which in turn results in a shifting of the electron beam (and resultant position of the focal spot on the anode target) in a prescribed 'x' and/or 'y' direction.

Figure 4:
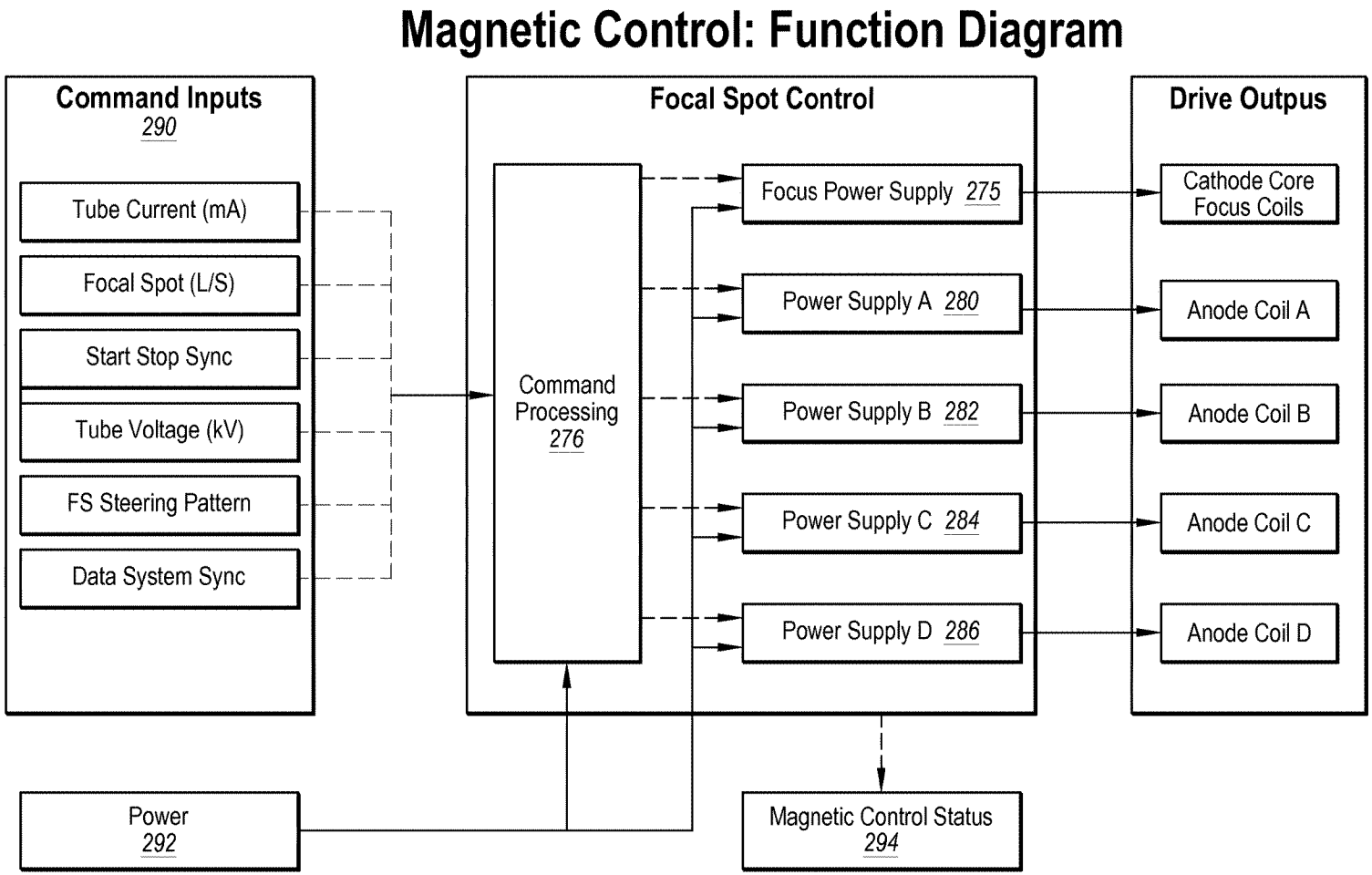
FIG. 4 is a functional block diagram showing one embodiment of a magnetic control for the quadrupole magnetic system of FIGS. 3A-3B.

Reference is next made to FIG. 4, which illustrates a functional diagram illustrating an embodiment of a magnetic control system for controlling the operation of the quadrupole system of FIGS. 3A-3B. At a high level, the magnetic control system of FIG. 4 provides the requisite control of coil currents supplied to the quadrupole cores 202 and 204 so as to (1) provide a requisite quadrupole field so as to achieve a desired focus of the focal spot; and (2) provide a requisite shift in the quadrupole field(s) so as to achieve a desired position of the focal spot. As noted, control of the coil currents is accomplished in a manner so as to achieve a desired steering frequency.

The embodiment of FIG. 4 includes a command processing device 276, which may be implemented with any appropriate programmable device, such as a microprocessor or microcontroller, or equivalent electronics. The command processing device 276 controls, for example, the operation of each of the independent power supplies (i.e., which provide corresponding coils operating current to create a magnetic field), preferably in accordance with parameters stored in non-volatile memory, such as that denoted at Command Inputs 290. For example, in an example operational scheme, parameters stored/defined in Command Inputs 290 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot); and Data System Sync (to sync an X-ray beam pattern with a corresponding imaging system).

In an exemplary implementation, command inputs 290 can correspond to requisite values in a look-up table arrangement. Focus Power Supply 275 supplies constant focus current to the coils of the cathode quadrupole core 204 described above. Similarly, Power Supply A (280), Power Supply B (282), Power Supply C (284) and Power Supply D (286) supply constant focus current to the corresponding coils of the anode quadrupole core 202 for the focusing component of each coil, and an AC offset current for purposes of steering the focal spot.

Thus, by way of one example, a Focal Spot size specified as 'small' can cause the Command Processing unit 276 to control the Focus Power Supply 275 to provide a constant focus current having the prescribed magnitude (corresponding to a 'small' focal spot) to each of the coils (206*a*, 208*a*, 206*b*, 208*b*) of the cathode magnetic quadrupole core 204, as described above. Similarly, each of the Power Supplies 280 (coil 210*a*), 282 (coil 212*b*), 284 (coil 210*b*), and 286 (coil 212*a*) can also be controlled to provide a constant focus current, having the same magnitude as supplied by Focus Power Supply 275, to each of the coils of the anode quadrupole core 202. Again, this can result in a quadrupole magnetic field that imposes focusing forces on the electron beam so as to result in a 'small' focal spot on the anode target (see, for example, the magnetic field of FIG. 6A).

Similarly, a FS Steering Pattern might prescribe a specific focal spot steering frequency and requisite displacement in an 'x' and/or 'y' direction. This can result in Command Processing unit 276 to control each of the Power Supplies 280, 282, 284, and 286 to supply a requisite X-offset and Y-offset AC current magnitudes to the corresponding coils (e.g., one coil, a pair of opposing coils, three coils, or two pairs of opposing coils) of the anode quadrupole core 202, thereby creating a desired steering effect, in addition to the beam (focal spot) focus, as described above.

In an example embodiment, each of the Power Supplies 275, 280, 282, 284 and 286 are high-speed switching supplies, and which receive electrical power from a main power supply denoted at 292. Magnetic Control Status 294 receives status information pertaining to the operation of the power supplies and the coils, and may be monitored by command processing unit 276 and/or an external monitor control apparatus (not shown).

Thus, in the embodiment of FIGS. 3A-3B and FIG. 4, a magnetic system providing electron beam focusing and two-axis beam steering via two quadrupoles is provided. While an example embodiment is shown, it will be appreciated that alternate approaches are contemplated. For example, while steering of the electron beam is provided by way of AC offset to one coil or a coil pair or three coils or two pairs of opposing coils on the anode quadrupole core 202, it will be appreciated that both the anode core 202 and the cathode core 204 might be constructed of a ferrite material, and the steering could be "split" between the cores, each providing a steering effect, one 'x' and one 'y' direction for example. Other variations can also be contemplated, such as both the cathode core and anode core implementing focusing and steering.

Accordingly, the offset can be applied to one coil or two opposing coils. In one example, AC offset is only applied to one coil to get steering in a diagonal direction. In another example, AC offset can be applied to both coils of an opposing coil pair. In one example, one coil of an opposing pair receives AC offset, and the other coil of the opposing pair can be set at zero AC offset. As such one coil can have AC offset in one coil set to zero and the other opposing coil of the pair has an AC offset that is not zero. In one embodiment, the coils of an opposing coil pair can have different offsets. In one embodiment, the AC offset in a pair of opposing coils can be created by having one coil with zero offset while the other has some offset. Application of AC offset to only one coil or having the coils of a coil pair with different AC offset can be applied to all embodiments.

Figure 5:
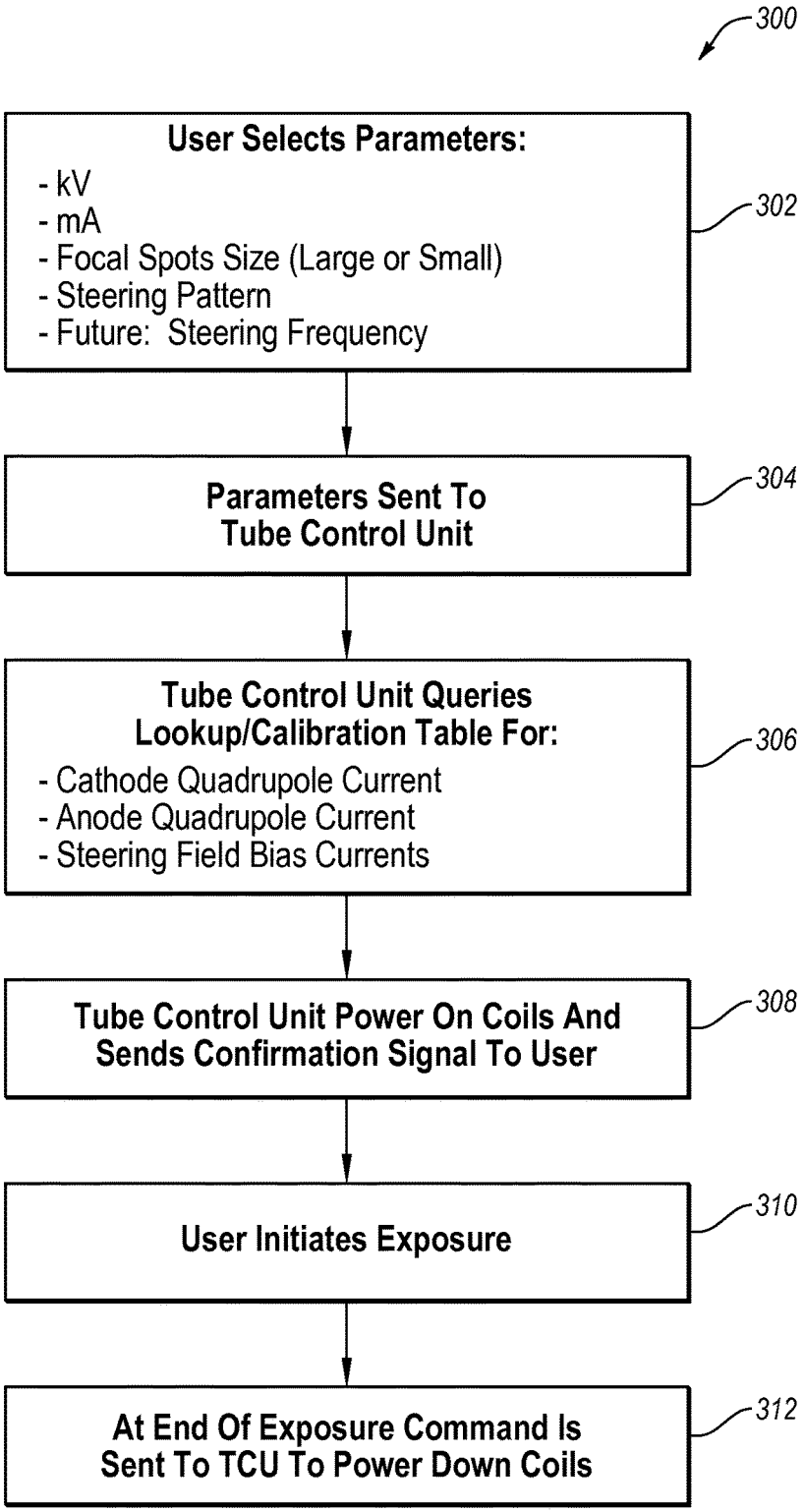
FIG. 5 is a flow chart showing one embodiment of a process control for magnetic control.

Reference is next made to FIG. 5, which illustrates one example of a methodology 300 for operating the magnetic control functionality denoted in FIG. 4. Beginning at step 302, a user may select or identify appropriate operating parameters, which are stored as command inputs in memory 290. At step 304, the operating parameters are forwarded to the tube control unit, which includes command processing unit 276. For each operating parameter, at step 306 the command processing unit 276 queries a lookup/calibration table for corresponding values, e.g., cathode quadrupole constant focus current, anode quadrupole constant focus current and AC offsets. At step 308, coils are powered on with respective current values, and confirmation is provided to the user. At step 310, the user initiates the exposure and X-ray imaging commences. At completion, step 312, a command is forwarded which causes power to the coils to be ceased.

Figure 7A:
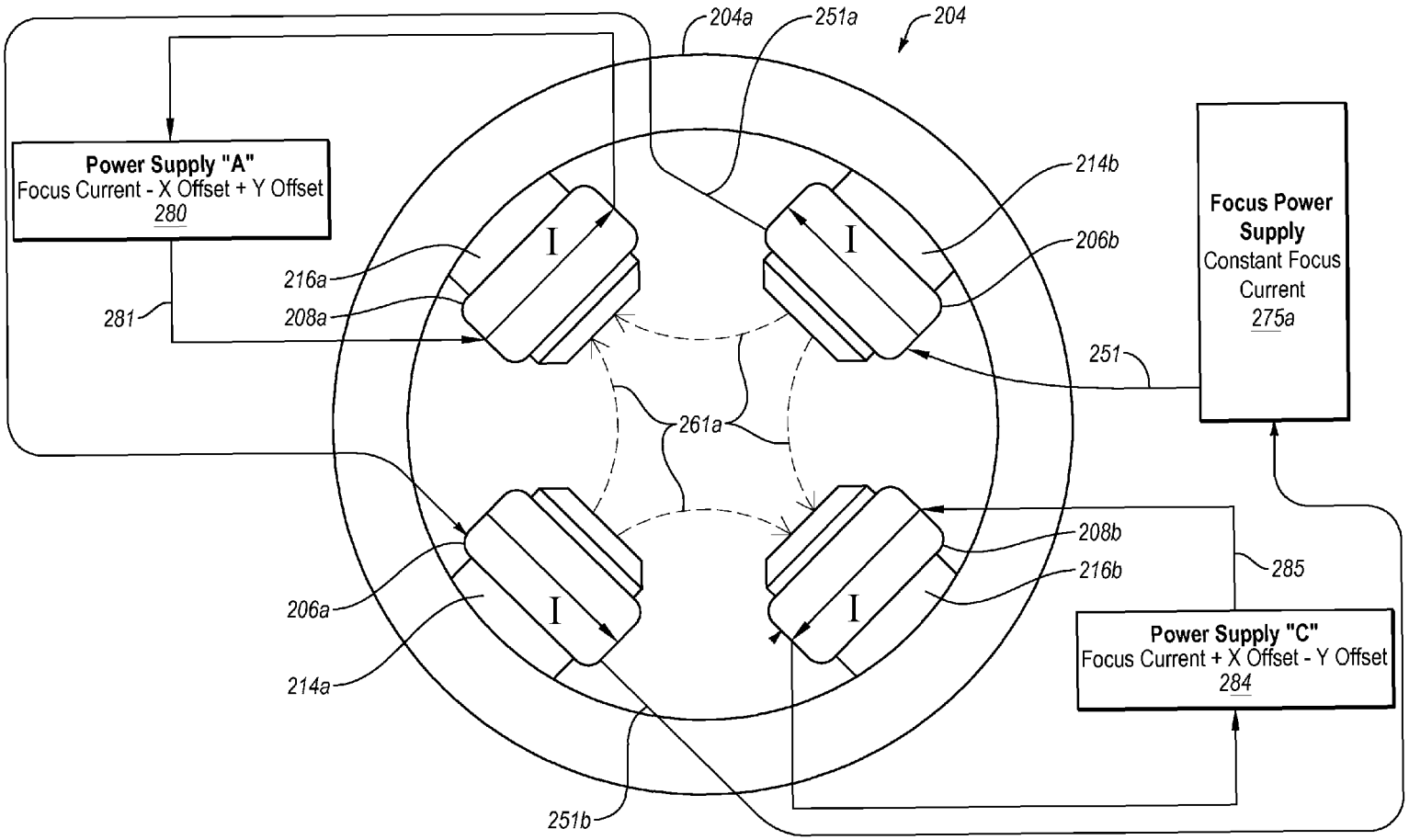
FIGS. 7A-7B are a top view of one embodiment of a quadrupole magnetic system.
Figure 7B:
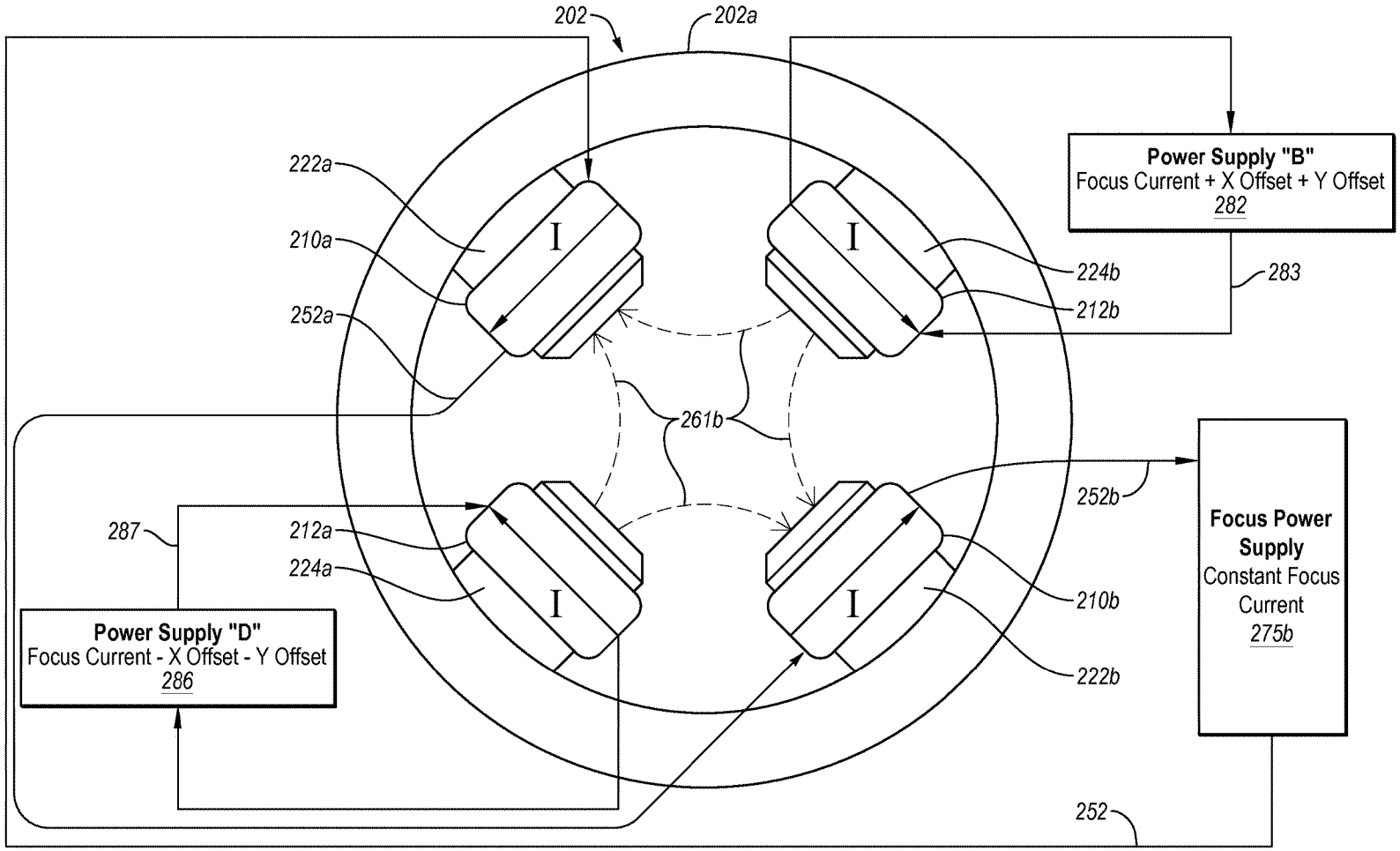

FIG. 7A shows an embodiment of a cathode core 204 having a cathode yoke 204*a* and is configured as a quadrupole (e.g., cathode-side magnetic quadrupole 204) for focusing with a pair of coils capable of having AC offset to implement steering, and FIG. 7B illustrates an embodiment of an anode core 202 having an anode yoke 202*a*, also configured as a quadrupole (e.g., anode-side magnetic quadrupole 202) for focusing with a pair of coils capable of having AC offset to implement steering. The steering of cathode core 204 is orthogonal to steering of anode core 202. The subject matter of FIG. 7A can include aspects of FIG. 3A, and the subject matter of FIG. 7B can include aspects of FIG. 3B as described herein.

As is further shown in FIG. 7A, the illustrated example includes a Focus Power Supply 275*a* for providing a predetermined constant focusing current to two of the four coils (e.g., 206*a* and 206*b*), which are connected in electrical series, as denoted schematically at 251, 251*a*, and 251*b*. Additionally, two of the coils (e.g., 208*a* and 208*b*) include separate and independent power source for providing current to induce a magnetic field in a respective coil, each power supply being denoted at 280 (Power Supply A) and 284 (Power Supply C). For purposes of providing a quadrupole magnetic field, a constant 'Focus Current' is provided to each of the coils, as denoted by the schematic electrical circuit associated with each supply (e.g., 281 and 285), which is matched by the Focus Power Supply 275*a*. In this embodiment, the current supplied in the coil is substantially constant, and results in a current flow within each coil as denoted by the letter 'I' and corresponding arrow, in turn resulting in a magnetic field schematically denoted at 261*a*. The magnitude of the current is selected so as to provide a desired magnetic field that results in a desired focusing effect.

Also, the cathode quadrupole core 204 is further configured to provide a steering effect in a manner that does not require additional coils. To do so, one or both the coils 208*a* and 208*b* are provided with—in addition to the constant focus current described above—an X AC offset current and a Y AC offset current. The duration of the AC offset currents are at a predetermined frequency and the respective offset current magnitudes are designed to achieve a desired offset or shifting of the center of the quadrupole field and, in turn, a resultant shift in the electron beam (and focal spot) from the center axis of the cores. Thus, coils 208*a* and 208*b* are driven independently, with a constant focus current, and steering perturbations are created in the magnetic field at the desired focal spot steering frequency by application of desired X AC offset and Y AC offset currents in at least one coil of corresponding coil pairs (e.g., opposing coils) of the cathode quadrupole core 204. This effectively moves the center of the magnetic field in the 'x' and/or 'y' direction, which in turn results in a shifting of the electron beam (and resultant position of the focal spot on the anode target) in a prescribed 'x' and/or 'y' direction.

As is further shown in FIG. 7B, the illustrated example includes a Focus Power Supply 275*b* for providing a predetermined constant current in two of the four coils (e.g., 210*a* and 210*b*), which are connected in electrical series, as denoted schematically at 252, 252*a*, and 252*b*. Additionally, two of the coils (e.g., 212*a* and 212*b*) include separate and independent power sources for providing current to induce a magnetic field in a respective coil, each power supply being denoted at 282 (Power Supply B) and 286 (Power Supply D). For purposes of providing a quadrupole magnetic field, a constant 'Focus Current' is provided to each of the coils, as denoted by the schematic electrical circuit associated with each supply (e.g., 283 and 287), which is matched by the Focus Power Supply 275*b*. In this embodiment, the current supplied results in the current in the coil being substantially constant, and results in a current flow within each coil as denoted by the letter 'I' and corresponding arrow, in turn resulting in a magnetic field schematically denoted at 261*b*. The magnitude of the current is selected so as to provide a desired magnetic field that results in a desired focusing effect. The focus current in the anode quadrupole core 202 is opposite to the cathode quadrupole core 204 focus current so as to provide for complimentary magnetic fields, and required focusing effect.

Also, the anode quadrupole core 202 is further configured to provide a steering effect in a manner that does not require additional coils. To do so, one or both of the coils 212*a* and 212*b* are provided with—in addition to the constant focus current described above—an X AC offset current and a Y AC offset current. The duration of the AC offset currents are at a predetermined frequency and the respective AC offset current magnitudes are designed to achieve a desired shifted quadrupole field (e.g., center of quadrupole shifted in X and/or Y) and, in turn, a resultant shift in the electron beam (and focal spot). Thus, coils 212*a* and 212*b* are driven independently, with a constant focus current, and steering perturbations are created in the magnetic field at the desired focal spot steering frequency by application of desired X AC offset and Y AC offset currents to one coil or both coils of the coil pair of the anode quadrupole core 202. This effectively moves the center of the magnetic field in the 'x' and/or 'y' direction, which in turn results in a shifting of the electron beam (and resultant position of the focal spot on the anode target) in a prescribed 'x' and/or 'y' direction. Thus, the combination of coil pairs 208*a,b* and coil pairs 212*a,b* provide steering in both the "x" and "y;" directions.

Figure 7C:
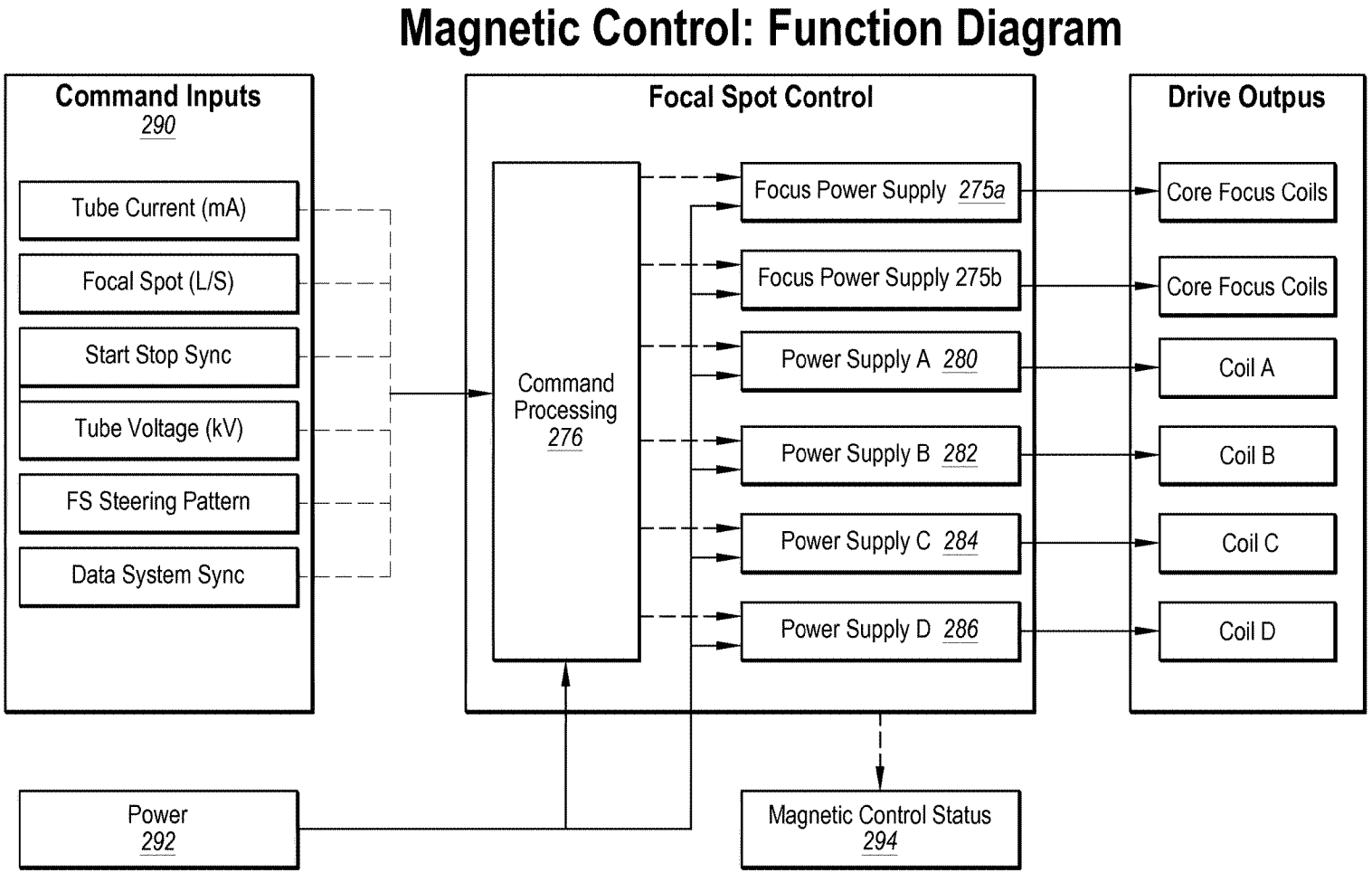
FIG. 7C is a functional block diagram showing one embodiment of a magnetic control for the quadrupole magnetic system of FIGS. 7A-7B.

Reference is next made to FIG. 7C, which illustrates a functional diagram illustrating an embodiment of a magnetic control system for controlling the operation of the quadrupole system of FIGS. 7A-7B. At a high level, the magnetic control system of FIG. 7C provides the requisite control of coil currents supplied to the quadrupole cores 202 and 204 so as to (1) provide a requisite quadrupole field so as to achieve a desired focus of the focal spot; and (2) provide a requisite shifted quadrupole field so as to achieve a desired position of the focal spot. As noted, control of the coil currents is accomplished in a manner so as to achieve a desired steering frequency.

The embodiment of FIG. 7C includes a command processing device 276, which may be implemented with any appropriate programmable device, such as a microprocessor or microcontroller, or equivalent electronics. The command processing device 276 controls, for example, the operation of each of the independent power supplies (i.e., which provide corresponding coils operating current to create a magnetic field), preferably in accordance with parameters stored in non-volatile memory, such as that denoted at Command Inputs 290. For example, in an example operational scheme, parameters stored/defined in Command Inputs 290 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot; and Data System Sync (to sync an X-ray beam pattern with a corresponding imaging system).

In an exemplary implementation, command inputs 290 can correspond to requisite values in a look-up table arrangement. Focus Power Supply 275*a* and Focus Power Supply 275*b* supply constant focus current to the coils of the cores 202 and 204 of FIG. 7A-7B. Similarly, Power Supply A (280), Power Supply B (282), Power Supply C (284) and Power Supply D (286) supply constant focus current to the corresponding coils of the cores 202 and 204 for the focusing component of each coil, and a AC offset current for purposes of shifting the quadrupole from the central axis.

Thus, by way of one example, a Focal Spot size specified as 'small' can cause the Command Processing unit 276 to control the Focus Power Supply 275*a* and Focus Power Supply 275*b* to provide a constant focus current having the prescribed magnitude (corresponding to a 'small' focal spot) to each of the coils (206*a*, 210*a*, 206*b*, 210*b*) of the cores 202 and 204, as described above. Similarly, each of the Power Supplies 280 (coil 208*a*), 282 (coil 212*b*), 284 (coil 208*b*), and 286 (coil 212*a*) can also be controlled to provide a constant focus current, having the same magnitude as supplied by Focus Power Supply 275*a* and Focus Power Supply 275*b*. Again, this can result in a quadrupole magnetic field that imposes focusing forces on the electron beam so as to result in a 'small' focal spot on the anode target.

Similarly, a FS Steering Pattern might prescribe a specific focal spot steering frequency and requisite displacement in an 'x' and/or 'y' direction. This can result in Command Processing unit 276 to control each of the Power Supplies 280, 282, 284, and 286 to supply a requisite X AC offset and Y AC offset current magnitudes to one coil, a pair of coils, three coils, or the pairs of coils of the corresponding coils of the cores 202 and 204, thereby creating a desired shifted quadrupole field for the steering effect, in addition to the beam (focal spot) focus, as described above.

In one embodiment, the steering quadrupole core can be operated under high speed switching with AC current. Such high speed switching can be at 6.5 to 7 kHz, and may include 20 microsecond transition times. Also, the focusing can have a magnetic flux that is about 400 gauss, whereas the steering can have a magnetic flux of 30-40. However, these values may vary, such as by 1, 2, 5, 10, or 20%.

An X-ray tube comprising: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and at least one coil of a pair of quadrupole coils having AC offset configured to deflect the electron beam in order to shift the focal spot of the electron beam on a target, at least one coil of a pair of quadrupole coils having AC offset being on the first yoke, the second yoke or on both the first and the second yoke.

It will be appreciated that various implementations of the electron beam steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil operably coupled to a power supply system that provides a constant current to each first quadrupole electromagnetic coil to produce a first focusing magnetic quadrupole field; a second magnetic quadrupole between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil operably coupled to the power supply system that provides a constant current to each second quadrupole electromagnetic coil to produce a second focusing quadrupole field; and at least one coil of a pair of opposing quadrupole electromagnetic coils of the first or second quadrupole electromagnetic coils operably coupled to the power supply system that provides an alternating current offset to at least one coil of the pair of opposing quadrupole electromagnetic coils to shift the first and/or second focusing quadrupole field from the central axis of the first and/or second quadrupole yokes. In one aspect, the X-ray tube can include two pairs of opposing quadrupole electromagnetic coils of the first and/or second quadrupole electromagnetic coils, which are operably coupled to the power supply system that provides an alternating current offset to at least one coil of each pair of the two pairs of opposing quadrupole electromagnetic coils to shift the first and/or second focusing quadrupole field from the central axis of the first and/or second quadrupole yokes.

In one aspect, a first pair of coils having AC offset is in a first plane and a second pair of coils having AC offset is in a different second plane. In one aspect, the first quadrupole electromagnetic coils form the two pairs of coils with at least one coil of each coil pair having AC offset. In one aspect, the second quadrupole electromagnetic coils form the two pairs of coils with at least one coil of each coil pair having AC offset. In one aspect, the two pairs of coils with at least one coil of each pair having AC offset are orthogonal.

In one embodiment, the X-ray tube has four power supplies. Each of these power supplies is operably coupled with only one of the first or second quadrupole electromagnetic coils so as to form the two pairs of coils, each pair of coils having at least one coil with AC offset.

In one embodiment, a first focus power supply is operably coupled with at least two opposing first quadrupole electromagnetic coils. Often, the first focus power supply is operably coupled with four quadrupole electromagnetic coils. In one aspect, a second focus power supply is operably coupled with at least two opposing second quadrupole electromagnetic coils. When a power supply is operably coupled with two quadrupole electromagnetic coils, the other two electromagnetic coils of the particular quadrupole have independent power supplies or opposing pairs of coils have independent power supplies. If one quadrupole has all four electromagnetic coils operably coupled with a common power supply, then the other quadrupole has all four electromagnetic coils operably coupled to four different power supplies. However, it should be recognized that a single power supply can be coupled to any number of coils to provide the same power to those coils, such as 2, 3, or 4 coils. Also, it may be possible for a single power supply to provide different currents to different coils.

In one embodiment, the X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction. In one aspect, a combination of the first and second magnetic quadrupoles provides a net focusing effect in both first and second directions of a focal spot of the electron beam.

In one embodiment, the X-ray tube can include two pairs of opposing coils with one coil of each coil pair having AC offset, where the two pairs of coils are configured to deflect the electron beam in two different directions in order to shift a focal spot of the electron beam on a target surface of the anode. The two pairs of opposing coils with AC offset are formed from two pairs of opposing coils of the quadrupole coils.

In one embodiment, the X-ray tube includes: the four first quadrupole pole projections having the first quadrupole electromagnetic coils being at 45, 135, 225, and 315 degrees; and the four second quadrupole pole projections having the second quadrupole electromagnetic coils being at 45, 135, 225, and 315 degrees.

In one embodiment, the X-ray tube can include the electron emitter having a substantially planar surface configured to emit electrons in an electron beam in a non-homogenous manner. In one aspect, the cathode can have a cathode head surface with one or more focusing elements located adjacent to the electron emitter. The emitter can be any electron emitter having a configuration to emit electrons in the electron beam to be substantially laminar beam. Any emitter that emits a substantially laminar beam (e.g., significantly laminar beam) can be used with the focusing and steering systems described herein.

In one embodiment, the X-ray tube can include: the first magnetic quadrupole being operably coupled with a first focus power supply; and each quadrupole electromagnetic coil with AC offset being operably coupled with a different steering power supply.

In one embodiment, an X-ray tube can include: a cathode including an emitter; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; and a second magnetic quadrupole formed on a second yoke and having a magnetic quadrupole gradient for focusing the electron beam in the second direction and defocusing the electron beam in the first direction. In one aspect, a combination of the first and second magnetic quadrupoles provides a net focusing effect in both first and second directions of a focal spot of the electron beam. In one aspect, electromagnet pairs of the first magnetic quadrupole or second magnetic quadrupole have AC offset to produce a shifted quadrupole field configured to deflect the electron beam in order to shift the focal spot of the electron beam on a target of the anode. In one aspect, the X-ray tube includes two electromagnet pairs of the first magnetic quadrupole and/or second magnetic quadrupole having AC offset to produce a shifted quadrupole field configured to deflect the electron beam in two orthogonal directions in order to shift the focal spot of the electron beam on a target of the anode. In one aspect, both pairs of opposing coils having AC offset are configured on the first yoke or the second yoke, or one pair of opposing coils having AC offset on each of the first yoke and the second yoke.

In one embodiment, a method of focusing and steering an electron beam in an X-ray tube can include: providing an X-ray tube of one of the embodiments (e.g., having at least one pair of opposing coils with one coil of each pair having AC offset); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the pair of opposing coils with AC offset to steer the electron beam away from the electron beam axis. In one aspect, the method can include operating opposing quadrupole electromagnetic coils with AC offset to have different powers to form an asymmetric quadrupole moment that is shifted from a central axis. In one aspect, the method can include forming a plurality of different focal spots at different locations on the anode for a given time interval, which time interval can be about 0.1, 0.2, 0.25, 0.3, 0.4, 0.5, 0.75, 1, 2, 3, 4, or 5 seconds, and generally less than 30 seconds. In one aspect, the method can include forming a plurality of different focal spots having different focal spot areas for a given time interval, which time interval can be the same or different from above.

In one embodiment, a method of focusing and steering an electron beam in an X-ray tube can include: providing the X-ray tube of one of the embodiments (e.g., having at least two pair of opposing coils with one coil of each pair having AC offset); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating a first pair of opposing coils with at least one coil of the first pair having AC offset to steer the electron beam away from the electron beam axis in a first direction; and operating a second pair of opposing coils with at least one coil of the second pair AC offset to steer the electron beam away from the electron beam axis in a second direction that is orthogonal to the first direction. In one aspect, the method can include operating opposing quadrupole electromagnetic coils independently with AC offset to have different currents to form a first asymmetric quadrupole moment. In one aspect, the method can include operating opposing quadrupole electromagnetic coils independently with AC offset to have different currents to form a second asymmetric quadrupole moment.

In one embodiment, one or both of the quadrupole cores can be devoid of electromagnetic coils wrapped around the core. The coils are on the pole projections, and the core is devoid of having coils wrapped around the core between the pole projections.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. An X-ray tube comprising:

a cathode including an electron emitter that emits an electron beam;

an anode configured to receive the electron beam;

a first magnetic quadrupole between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil operably coupled to a power supply system that provides a constant current to each first quadrupole electromagnetic coil to produce a first focusing magnetic quadrupole field;

a second magnetic quadrupole between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil operably coupled to the power supply system that provides a constant current to each second quadrupole electromagnetic coil to produce a second focusing quadrupole field; and four of the quadrupole electromagnetic coils of the first and/or second quadrupole electromagnetic coils, including a first set of two opposing quadrupole electromagnetic coils in a plane forming a first pair and including a second set of two opposing quadrupole electromagnetic coils in a plane forming a second pair, are operably coupled to the power supply system that provides an alternating current offset to the four quadrupole electromagnetic coils to shift the first and/or second focusing quadrupole fields from the central axis of the first and/or second quadrupole yokes.

2. The X-ray tube of claim 1, wherein the first pair of opposing quadrupole electromagnetic coils are first quadrupole electromagnetic coils on the first quadrupole pole projections extending from the first quadrupole yoke and the second pair of opposing quadrupole electromagnetic coils is in a different second plane are second quadrupole electromagnetic coils on the first quadrupole pole projections extending from the first quadrupole yoke.

3. The X-ray tube of claim 2, comprising four alternating current offset power supplies, each being operably coupled with one of the first quadrupole electromagnetic coils and/or second quadrupole electromagnetic coils so as to form the first pair and second pair of opposing quadrupole electromagnetic coils.

4. The X-ray tube of claim 1, wherein the four first quadrupole electromagnetic coils form the first pair and second pair of opposing quadrupole electromagnetic coils.

5. The X-ray tube of claim 4, comprising four alternating current offset power supplies, each being operably coupled with one of the first quadrupole electromagnetic coils and/or second quadrupole electromagnetic coils so as to form the first pair and second pair of opposing quadrupole electromagnetic coils.

6. The X-ray tube of claim 1, wherein the four second quadrupole electromagnetic coils form the first pair and second pair of opposing quadrupole electromagnetic coils.

7. The X-ray tube of claim 6, comprising four alternating current offset power supplies, each being operably coupled with one of the first quadrupole electromagnetic coils and/or second quadrupole electromagnetic coils so as to form the first pair and second pair of opposing quadrupole electromagnetic coils.

8. The X-ray tube of claim 1, comprising four alternating current offset power supplies, each being operably coupled with one of the first quadrupole electromagnetic coils and/or second quadrupole electromagnetic coils so as to form the first pair and second pair of opposing quadrupole electromagnetic coils.

9. The X-ray tube of claim 1, comprising:

a first focus power supply operably coupled with at least one coil of two opposing first quadrupole electromagnetic coils; and/or a second focus power supply operably coupled with at least one coil of two opposing second quadrupole electromagnetic coils.

10. The X-ray tube of claim 1, comprising:

the first magnetic quadrupole being configured for providing a first magnetic quadrupole gradient for focusing the electron beam in a first direction and defocusing the electron beam in a second direction orthogonal to the first direction; and the second magnetic quadrupole being configured for providing a second magnetic quadrupole gradient for focusing the electron beam in the second direction and defocusing the electron beam in the first direction;

wherein a combination of the first and second magnetic quadrupoles provides a net focusing effect in both first and second directions of a focal spot of the electron beam, wherein the first pair and second pair of quadrupole electromagnetic coils that are operably coupled to the power supply system that provides an alternating current offset cooperate to deflect the electron beam in order to shift a focal spot of the electron beam on a target surface of the anode into one of four quadrants.

11. The X-ray tube of claim 1, comprising:

the four first quadrupole pole projections having the first quadrupole electromagnetic coils being at 45, 135, 225, and 315 degrees; and the four second quadrupole pole projections having the second quadrupole electromagnetic coils being at 45, 135, 225, and 315 degrees.

12. The X-ray tube of claim 1, comprising the electron emitter with a planar emission surface having a configuration to emit electrons from the planar emission surface in the electron beam to be a substantially laminar beam.

13. The X-ray tube of claim 12, the cathode having a cathode head surface with one or more focusing elements located adjacent to the electron emitter.

14. A method of focusing and steering an electron beam in an X-ray tube, the method comprising:

providing the X-ray tube of claim 1;

operating the electron emitter so as to emit the electron beam from the cathode to the anode along an electron beam axis;

operating the first magnetic quadrupole to focus the electron beam in a first direction;

operating the second magnetic quadrupole to focus the electron beam in a second direction orthogonal with the first direction; and operating at least one coil of the first pair and/or second pair of opposing quadrupole electromagnetic coils to have alternating current offset to steer the electron beam away from the electron beam axis.

15. The method of claim 14, comprising operating opposing quadrupole electromagnetic coils of the first pair and/or second pair of opposing coils with alternating current offset to have different currents to form an asymmetric quadrupole moment.

16. The method of claim 14, comprising forming a plurality of different focal spots at different locations on the anode for a given time interval.

17. The method of claim 16, wherein the time interval is 0.25 seconds.

18. The method of claim 14, comprising forming a plurality of different focal spots having different focal spot areas for a given time interval.

19. The method of claim 18, wherein the time interval is 0.25 seconds.

20. A method of focusing and steering an electron beam in an X-ray tube, the method comprising:

providing the X-ray tube of claim 1;

operating the electron emitter so as to emit the electron beam from the cathode to the anode along an electron beam axis;

operating the first magnetic quadrupole to focus the electron beam in a first direction;

operating the second magnetic quadrupole to focus the electron beam in a second direction orthogonal with the first direction;

operating a first coil of the first pair of opposing quadrupole electromagnetic coils having alternating current offset to steer the electron beam away from the electron beam axis in a first direction; and operating a second coil of the second pair of opposing quadrupole electromagnetic coils having alternating current offset to steer the electron beam away from the electron beam axis in a second direction that is orthogonal to the first direction.

21. The method of claim 20, comprising:

operating opposing quadrupole electromagnetic coils of the first pair of opposing quadrupole electromagnetic coils having alternating current offset to have different currents to form a first asymmetric quadrupole moment; and operating opposing quadrupole electromagnetic coils of the second pair of opposing quadrupole electromagnetic coils having alternating current offset to have different currents to form a second asymmetric quadrupole moment.

22. The X-ray tube of claim 1, wherein:

the first pair have the first quadrupole electromagnetic coils at 45 and 225 degrees; and the second pair have the second quadrupole electromagnetic coils at 135 and 315 degrees.

23. The X-ray tube of claim 1, wherein:

the second pair have the second quadrupole electromagnetic coils at 45 and 225 degrees; and the first pair have the first quadrupole electromagnetic coils at 135 and 315 degrees.

24. An X-ray tube comprising:

a cathode including an emitter that emits an electron beam;

an anode configured to receive the emitted electrons;

a first magnetic quadrupole formed on a first yoke and having a magnetic quadrupole gradient for focusing the electron beam in a first direction and defocusing the electron beam in a second direction perpendicular to the first direction;

a second magnetic quadrupole formed on a second yoke and having a magnetic quadrupole gradient for focusing the electron beam in the second direction and defocusing the electron beam in the first direction;

wherein a combination of the first and second magnetic quadrupoles provides a net focusing effect in both first and second directions of a focal spot of the electron beam; and at least one coil of a first opposing coil pair of the first magnetic quadrupole or second magnetic quadrupole receives alternating current offset from a first power supply so as to be configured to deflect the electron beam in order to shift the focal spot of the electron beam on a target of the anode; and at least one coil of a second opposing coil pair of the first magnetic quadrupole or second magnetic quadrupole receives alternating current offset from a second power supply so as to be configured to deflect the electron beam in order to shift the focal spot of the electron beam on a target of the anode orthogonally from the shift by the first opposing coil pair.

25. The X-ray tube of claim 24, comprising the first opposing coil pair and second opposing coil pair being two coil pairs of the first magnetic quadrupole and/or second magnetic quadrupole, each of the coils of the first opposing coil pair and second opposing coil pair having alternating current offset so as to be configured to deflect the electron beam in order to shift the focal spot of the electron beam on a target of the anode.

26. The X-ray tube of claim 25, wherein both pairs of the first opposing coil pair and second opposing coil pair being opposing quadrupole electromagnetic coils have alternating current offset and are configured on the first yoke or the second yoke, or one pair of opposing quadrupole electromagnetic coils having alternating current offset on each of the first yoke and the second yoke.

* * * * *